US009129597B2

(12) United States Patent
Bayer et al.

(10) Patent No.: US 9,129,597 B2
(45) Date of Patent: Sep. 8, 2015

(54) AUDIO SIGNAL DECODER, AUDIO SIGNAL ENCODER, METHODS AND COMPUTER PROGRAM USING A SAMPLING RATE DEPENDENT TIME-WARP CONTOUR ENCODING

(75) Inventors: Stefan Bayer, Nuremberg (DE); Tom Baeckstroem, Nuremberg (DE); Ralf Geiger, Erlangen (DE); Bernd Edler, Fürth (DE); Sascha Disch, Fuerth (DE); Lars Villemoes, Jaerfaella (SE)

(73) Assignees: Fraunhofer-Gesellschaft zur Foerderung der angewandten Forschung e. V., Munich (DE); Dolby International AB, Amsterdam Zuid-Oost (NL)

( * ) Notice: Subject to any disclaimer, the term of this patent is extended or adjusted under 35 U.S.C. 154(b) by 295 days.

(21) Appl. No.: 13/604,869

(22) Filed: Sep. 6, 2012

(65) Prior Publication Data

US 2013/0073296 A1 Mar. 21, 2013

Related U.S. Application Data

(63) Continuation of application No. PCT/EP2011/053538, filed on Mar. 9, 2011.

(60) Provisional application No. 61/312,503, filed on Mar. 10, 2010.

(51) Int. Cl.
*G10L 19/00* (2013.01)
*G10L 19/022* (2013.01)
(Continued)

(52) U.S. Cl.
CPC ..... *G10L 19/022* (2013.01); *G10L 19/0212* (2013.01); *G10L 25/90* (2013.01)

(58) Field of Classification Search
CPC ... G10L 19/00; G10L 19/0017; G10L 19/002; G10L 19/022; G10L 19/167; G10L 19/172
USPC ..... 704/500, 501, 504
See application file for complete search history.

(56) References Cited

U.S. PATENT DOCUMENTS 6,581,032 B1 * 6/2003 Gao et al. ..... 704/222
7,272,556 B1 9/2007 Aguilar et al.
(Continued)

FOREIGN PATENT DOCUMENTS

CN 101325060 12/2008
JP 2011-527458 10/2011
(Continued)

OTHER PUBLICATIONS

"WD6 of USAC", International Organisation for Standardisation Organisation Internationale De Normalisation ISO/IEC JTC1/SC29/WG11 Coding of Moving Pictures and Audio. Kyoto, Japan., Jan. 2010, 1-237.
(Continued)

*Primary Examiner* — Qi Han
(74) *Attorney, Agent, or Firm* — Michael A. Glenn; Perkins Coie LLP

(57) ABSTRACT

An audio signal decoder configured to provide a decoded audio signal representation on the basis of an encoded audio signal representation including a sampling frequency information, an encoded time warp information and an encoded spectrum representation includes a time warp calculator and a warp decoder. The time warp calculator is configured to adapt a mapping rule for mapping codewords of the encoded time warp information onto decoded time warp values describing the decoded time warp information in dependence on the sampling frequency information. The warp decoder is configured to provide the decoded audio signal representation on the basis of the encoded spectrum representation and in dependence on the decoded time warp information.

17 Claims, 28 Drawing Sheets

(51) Int. Cl.
*G10L 19/02* (2013.01)
*G10L 25/90* (2013.01)

(56) References Cited

U.S. PATENT DOCUMENTS

| | | | | |
|---|---|---|---|---|
| 8,078,474 | B2 * | 12/2011 | Vos et al. | 704/500 |
| 2004/0098255 | A1 * | 5/2004 | Kovesi et al. | 704/219 |
| 2007/0100607 | A1 | 5/2007 | Villemoes | |
| 2008/0312914 | A1 * | 12/2008 | Rajendran et al. | 704/207 |
| 2009/0012797 | A1 | 1/2009 | Boehm et al. | |
| 2011/0178795 | A1 | 7/2011 | Bayer et al. | |
| 2011/0295598 | A1 | 12/2011 | Yang et al. | |

FOREIGN PATENT DOCUMENTS

| | | |
|---|---|---|
| WO | WO-2007051548 | 5/2007 |
| WO | WO2008/157296 | 12/2008 |
| WO | WO2009/121499 | 10/2009 |
| WO | WO2010/003479 | 1/2010 |
| WO | WO-2010003581 | 1/2010 |
| WO | WO-2010003582 | 1/2010 |
| WO | WO-2010003583 | 1/2010 |
| WO | WO-2010003618 | 1/2010 |

OTHER PUBLICATIONS

Dunn, R et al., "Sinewave Analysis/Synthesis Based on the Fan-Chirp Transform*", 2007 IEEE Workshop on Applications of Signal Processing to Audio and Asoustics, 2007, 247-250.

Edler, B et al., "A Time-Warped MDCT Approach to Speech Transform Coding", Presented at the 126th AES Convention. Munich, Germany. Convention Paper 7710. XP40508992, May 7, 2009, 1-8.

Edler, B et al., "Time Warped MDCT", Provisional application for patent by Fraunhofer Gesellschaft. Version 3.0., Mar. 28, 2008, 1-6.

Kepesi, M et al., "Adaptive Chirp-based Time-Frequency Analysis of Speech Signals", Speech Communication 48. www.elsevier.com/locate/specom, 2006, 474-492.

Meine, N et al., "Improved Quantization and Lossless Coding for Subband Audio Coding", Presented at the 118th AES Convention. Barcelona, Spain., May 2005, 9 Pages.

Meine, N et al., "Vektorquantisierung und kontextabhangige arithmetische Codierung fur MPEG-4 AAC", VDI. Hannover., 2007, 121 Pages.

Huang, Zhenhua et al., "Speaker Normalization Using Dynamic Frequency Warping", The IEEE International Conference on Audio, Language and Image Processing, Jul. 2008 (ICALIP 2008), Jul. 7, 2008, pp. 1091-1995.

Silsbee, Peter L. et al., "A warped time-frequency expansion for speech signal representation", Time-Frequency and Time-Scale Analysis, Department of Electrical and Computer Engineering, Norfolk, VA, IEEE1994, 636-639.

Neuendorf, M et al., "A Novel Scheme for Low Bitrate Unified Speech and Audio Coding", Presented at the 126th AES Convention. München, Germany., May 2009, pp. 1-13.

* cited by examiner

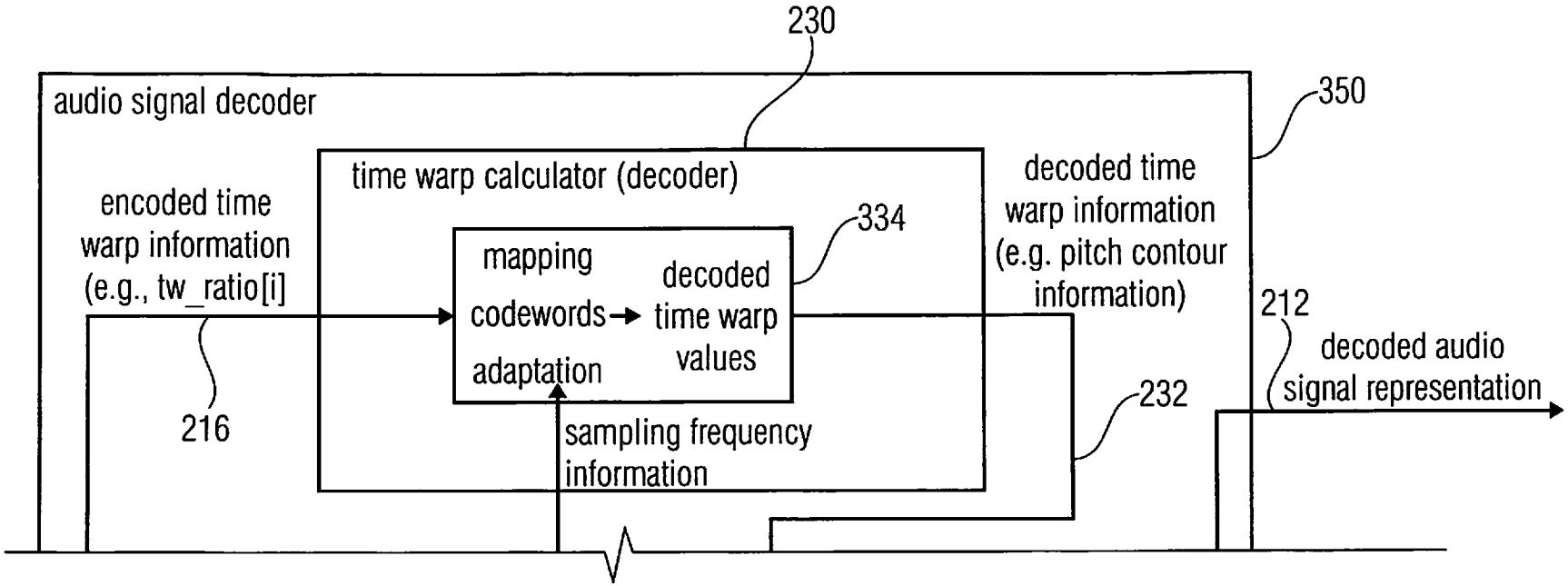
FIG 3B1
| FIG 3B1 | FIG 3B |
|---|---|
| FIG 3B2 | |

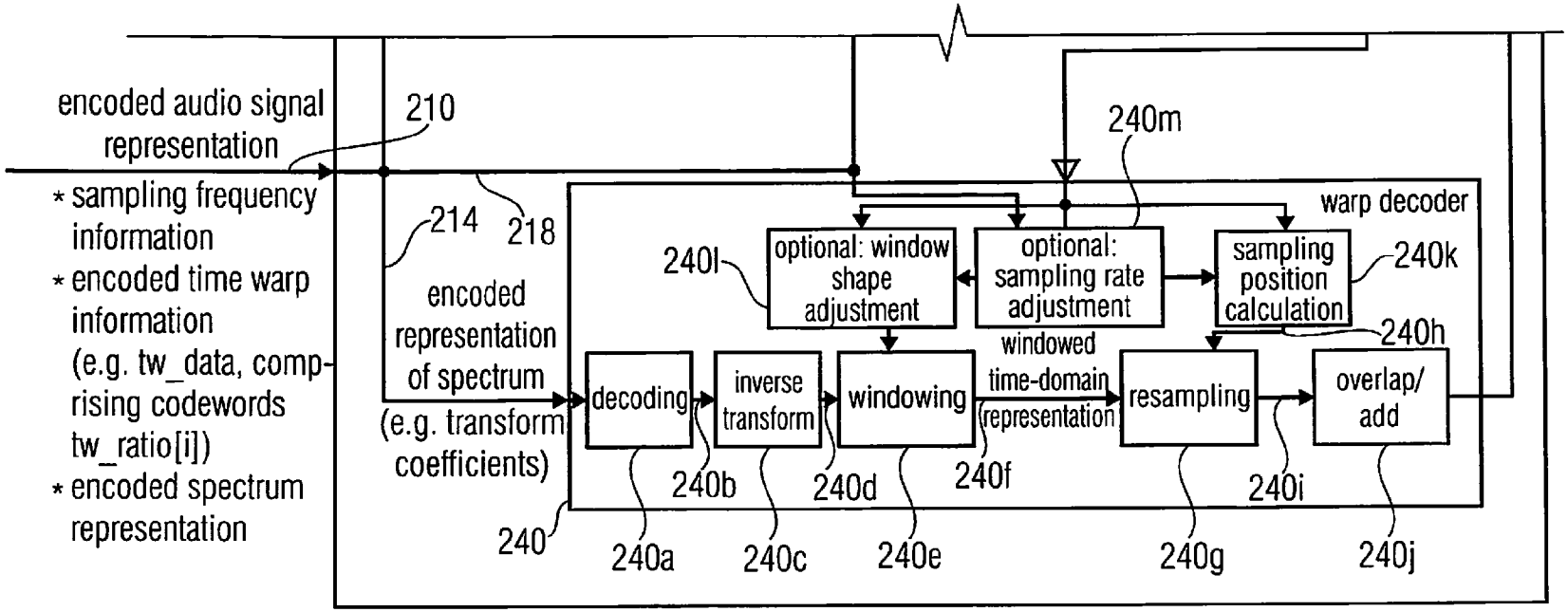
FIG 3B2
| FIG 3B1 | FIG 3B |
|---|---|
| FIG 3B2 | |

| index (=tw_ratio[]) | $p_{rel}$ | warp(oct/s)@$f_s$ | |
|---|---|---|---|
| | | 24000 | 12000 |
| 0 | 0,98285717 | -9,3549 | -4,6774 |
| 1 | 0,98857141 | -6,2186 | -3,1093 |
| 2 | 0,99428570 | -3,1004 | -1,5502 |
| 3 | 1,00000000 | 0,0000 | 0,0000 |
| 4 | 1,00571430 | 3,0827 | 1,5413 |
| 5 | 1,01142859 | 6,1479 | 3,0740 |
| 6 | 1,01714289 | 9,1959 | 4,5979 |
| 7 | 1,02285719 | 12,2268 | 6,1134 |

FIG 4C 480 482 484 486

| index (=tw_ratio[]) | warp | $p_{rel}$@$f_s$ | |
|---|---|---|---|
| | | 24000 | 12000 |
| 0 | -9,3548701 | 0,9828572 | 0,9660082 |
| 1 | -6,2185945 | 0,9885714 | 0,9772734 |
| 2 | -3,1003621 | 0,9942857 | 0,9886041 |
| 3 | 0,0000000 | 1,0000000 | 1,0000000 |
| 4 | 3,0826977 | 1,0057143 | 1,0114613 |
| 5 | 6,1479243 | 1,0114286 | 1,0229878 |
| 6 | 9,1958872 | 1,0171429 | 1,0345797 |
| 7 | 12,2267745 | 1,0228572 | 1,0462368 |

FIG 4D 490 492 494 496

| index (=tw_ratio[]) | $p_{rel,ref}$ | $p_{rel}@f_s$ | |
|---|---|---|---|
| | | 24000 | 12000 |
| 0 | 0,9828572 | 0,9828572 | 0,9657143 |
| 1 | 0,9885714 | 0,9885714 | 0,9771428 |
| 2 | 0,9942857 | 0,9942857 | 0,9885714 |
| 3 | 1,0000000 | 1,0000000 | 1,0000000 |
| 4 | 1,0057143 | 1,0057143 | 1,0114286 |
| 5 | 1,0114286 | 1,0114286 | 1,0228572 |
| 6 | 1,0171429 | 1,0171429 | 1,0342858 |
| 7 | 1,0228572 | 1,0228572 | 1,0457144 |

($f_{s,ref}$=24000Hz)

FIG 4E

| FIG 5A | FIG 5 |
|---|---|
| FIG 5B | |

| FIG 5A | FIG 5 |
|---|---|
| FIG 5B | |

| FIG 6A | FIG |
|---|---|
| FIG 6B | 6 |

| FIG 6A | FIG |
|---|---|
| FIG 6B | 6 |

Definitions

Data elements

| | |
|---|---|
| tw_data() | contains the side information necessary to decode and apply the time warped MDCT on an fd_channel_stream() for SCE and CPE elements. The fd_channel_streams of a channel_pair_element() may share one common tw_data(). |
| **tw_data_present** | 1 bit indicating that a non-flat warp contour is transmitted in this frame |
| **tw_ratio[]** | codebook index of the warp ratio for node i. |
| **window_sequence** | 2 bit indicating which window sequence (i.e. block size) is used |
| **window shape** | 1 bit indicating which window function is selected |

Help elements

| | |
|---|---|
| warp_node_values[] | decoded warp contour node values |
| warp_value_tbl[] | quantization table for the warp node ratio values, please see FIG 8 |
| new_warp_contour[] | decoded and interpolated warp contour for this frame (n_long samples) |
| past_warp_contour[] | past warp contour (2*n_long samples) |
| norm_fac | normalization factor for the past *warp*_contour |
| warp_contour[] | complete warp contour (3*n_long samples) |
| last_warp_sum | sum of first part of the warp contour |
| cur_warp_sum | sum of the middle part of the warp contour |
| next_warp_sum | sum of the last part of the warp contour |
| time_contour[] | complete time contour (3*n_long+1_samples) |
| sample_pos[] | positions of the warped samples on a linear time scale (2*n_long samples + 2*IP_LEN_2S) |

| | |
|---|---|
| FIG 7A1 | FIG |
| FIG 7A2 | 7A |

FIG 7A1

| | |
|---|---|
| X[w][] | output of the IMDCT for window w |
| z[] | windowed and (optionally) internally overlapped time vector for one frame in the time warped domain |
| zp[] | z[] with zero padding |
| y[] | time vector for one frame in the linear time domain after resampling |
| $y'_{i,n}$ | time vector for frame i after postprocessing |
| out[] | output vector for one frame |
| b[] | impulse response of the resampling filter |
| N | synthesis window length |
| N_f | frame length, N_f = 2**coreCoderFrameLength* |
| next_window_sequence | following window sequence |
| prev_window_sequence | previous window sequence |

FIG 7A2

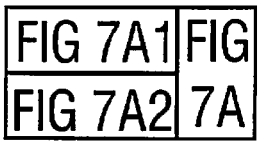

Constants

| | |
|---|---|
| NUM_TW_NODES | 16 |
| OS_FACTOR_WIN | 16 |
| OS_FACTOR_RESAMP | 128 |
| IP_LEN_2S | 12 |
| IP_LEN_2 | OS_FACTOR_RESAMP*IP_LEN_2S+1 |
| IP_SIZE | IP_LEN_2+OS_FACTOR_RESAMP |
| n_long | *coreCoderFrameLength* |
| n_short | *coreCoderFrameLength/8* |
| interp_dist | n_long/NUM_TW_NODES |
| NOTIME | -100000 |

FIG 7B table: warp_value_tbl

| index | value |
|---|---|
| 0 | 0.982857168 |
| 1 | 0.988571405 |
| 2 | 0.994285703 |
| 3 | 1 |
| 4 | 1.0057143 |
| 5 | 1.01142859 |
| 6 | 1.01714289 |
| 7 | 1.02285719 |

FIG 8

```
for ( i = 0 ; i < NUM_TW_NODES ; i++ ) {
    d = (warp_node_values[i+1]  warp_node_values[i] ) / interp_dist;
    for ( j = 0 ; j < interp_dist; j++ ) {
        new_warp_contour[i*interp_dist + j] = warp_node_values[i-1] + (j+1)*d;
    }
}
```

FIG 9

```
warp_time_inv(time_contour[],t_warp) {
    i = 0;
    if ( t_warp < time_contour[0] ) {
        return NOTIME;
    }
    while ( t_warp > time_contour[i+1] ) {
        i++;
    }
    return (i + (t_warp  time_contour[i])/(time_contour[i+1]-time_contour[i]));
}
```

FIG 10A

```
warp_inv_vec(time_contour[],t_start,n_samples,sample_pos[]) {
    t_warp = t_start;
    j = 0;
    while (( i = floor(warp_time_inv(time_contour,t_warp-0.5))) == NOTIME) {
        t_warp += 1;
        j++;
    }
    while ( j < n_samples && (t_warp + 0.5) < time_contour[3*n_long] ) {
        while ( t_warp > time_contour[i+1]) {
            i++;
        }
        sample_pos[j] =
            i + (t_warp  time_contour[i])/(time_contour[i+1]-time_contour[i]);
        j++;
        t_warp += 1;
    }
}
```

FIG 10B

```
t_start=n_long-3*N_f/4 - IP_LEN_2S + 0.5

warp_inv_vec(time_contour,
        t_start,
        N_f + 2*IP_LEN_2S,
        sample_pos[]);

if ( last_warp_sum > cur_warp_sum ) {
    warped_trans_len_left = n_long/2;
}
else {
    warped_trans_len_left = n_long/2*last_warp_sum/cur_warp_sum;
}

if (new_warpSum > cur_warp_sum ) {
    warped_trans_len_right = n_long/2;
}
else {
    warped_trans_len_right = n_long/2*new_warp_sum/cur_warp_sum;
}

switch ( window_sequence ) {
    case LONG_START_SEQUENCE:
        if ( next_window_sequence == LPD_SEQUENCE ) {
            warped_trans_len_right /= 4;
        }
        else {
            warped_trans_len_right /= 8;
        }
        break;
    case LONG_STOP_SEQUENCE:
        if ( prev_window_sequence == LPD_SEQUENCE ) {
            warped_trans_len_left /= 4;
        }
        else {
            warped_trans_len_left /= 8;
        }
        break;
```

FIG 11A

| FIG 11A | FIG |
|---|---|
| FIG 11B | 11 |

```
    case EIGHT_SHORT_SEQUENCE:
        warped_trans_len_right /= 8;
        warped_trans_len_left /= 8;
        break;
    case STOP_START_SEQUENCE:
        if ( prev_window_sequence == LPD_SEQUENCE ) {
            warped_trans_len_left /= 4;
        }
        else {
            warped_trans_len_left /= 8;
        }
        if ( next_window_sequence == LPD_SEQUENCE ) {
            warped_trans_len_right /= 4;
        }
        else {
            warped_trans_len_right /= 8;
        }
        break;
}
first_pos = ceil(N_f/4-0.5-warped_trans_len_left);
last_pos = floor(3*N_f/4-0.5+warped_trans_len_right);
```

FIG 11B

| FIG 11A | FIG |
|---|---|
| FIG 11B | 11 |

value of synthesis window length N depending on window_sequence and coreCoderframeLength

| window_sequence | coreCoderFrameLength ==768 | coreCoderFrameLength ==1024 |
|---|---|---|
| ONLY_LONG_SEQUENCE<br>LONG_START_SEQUENCE<br>LONG_STOP_SEQUENCE<br>STOP_START_SEQUENCE | 1536 | 2048 |
| EIGHT_SHORT-SEQUENCE | 192 | 256 |

FIG 12 allowed window sequences

| window sequence<br>from↓ to→ | ONLY_LONG_SEQUENCE | LONG_START_SEQUENCE | EIGHT_SHORT_SEQUENCE | LONG_STOP_SEQUENCE | STOP_START_SEQUENCE | LPD_SEQUENCE |
|---|---|---|---|---|---|---|
| ONLY_LONG_SEQUENCE | ☑ | ☑ | | | | |
| LONG_START_SEQUENCE | | | ☑ | ☑ | ☑ | ☑ |
| EIGHT_SHORT_SEQUENCE | | | ☑ | ☑ | ☑ | ☑ |
| LONG_STOP_SEQUENCE | ☑ | ☑ | | | | |
| STOP_START_SEQUENCE | | | ☑ | ☑ | ☑ | ☑ |
| LPD_SEQUENCE | | | ☑ | ☑ | ☑ | ☑ |

FIG 13

```
tw_windowing_short(X[][],z[],first_pos,last_pos,warpe_trans_len_left,warped_trans_len_righ
t,left_window_shape[],right_window_shape[]) {

   offset = n_long – 4*n_short – n_short/2;

   tr_scale_1 = 0.5*n_long/warped_trans_len_left*OS_FACTOR_WIN;
   tr_pos_l = warped_trans_len_left+(first_pos-n_long/2)+0.5)*tr_scale_l;
   tr_scale_r = 8*OS_FACTOR_WIN;
   tr_pos_r = tr_scale_r/2;

   for ( i = 0 ; i < n_short ; i++ ) {
      z[i] = X[0][i];
   }

   for (i=0;i<first_pos;i++)
      z[i] = 0.;

   for (i=n_long-1-first_pos;i>=first_pos;i--) {
      z[i] *= left_window_shape[floor(tr_pos_l)];
      tr_pos_l += tr_scale_l;
   }

   for (i=0;i<n_short;i++) {
      z[offset+i+n_short]=
         X[0][i+n_short]*right_window_shape[floor(tr_pos_r)];
      tr_pos_r += tr_scale_r;
   }

   offset += n_short;
```

FIG 14A

| FIG 14A | FIG |
|---|---|
| FIG 14B | 14 |

```
for ( k = 1 ; k < 7 ; k++ ) {
   tr_scale_l = n_short*OS_FACTOR_WIN;
   tr_pos_l = tr_scale_l/2;
   tr_pos_r = OS_FACTOR_WIN*n_long-tr_pos_l;
   for ( i = 0 ; i < n_short ; i++ ) {
      z[i + offset] += X[k][i]*right_window_shape[floor(tr_pos_r)];
      z[offset + n_short + i] =
         X[k][n_short + i]*right_window_shape[floor(tr_pos_l)];
      tr_pos_l += tr_scale_l;
      tr_pos_r -= tr_scale_l;
   }
   offset += n_short;
}

tr_scale_l = n_short*OS_FACTOR_WIN;
tr_pos_l = tr_scale_l/2;

for ( i = n_short - 1 ; i >= 0 ; i-- ) {
   z[i + offset] += X[7][i]*right_window_shape[(int) floor(tr_pos_l)];
   tr_pos_l += tr_scale_l;
}

   for ( i = 0 ; i < n_short ; i++ ) {
   z[offset + n_short + i] = X[7][n_short + i];
}

tr_scale_r = 0.5*n_long/warpedTransLenRight*OS_FACTOR_WIN;
tr_pos_r = 0.5*tr_scale_r+.5;

tr_pos_r = (1.5*n_long-(float)wEnd-0.5+warpedTransLenRight)*tr_scale_r;
for (i=3*n_long-1-last_pos ;i<=wEnd;i++) {
   z[i] *= right_window_shape[floor(tr_pos_r)];
   tr_pos_r += tr_scale_r;
}

for (i=lsat_pos+1;i<2*n_long;i++)
   z[i] = 0.;
```

FIG 14B

| FIG 14A | FIG |
|---|---|
| FIG 14B | 14 |

```
tw_windowing_long(X[][],z[],first_pos,last_pos,warpe_trans_len_left,warped_trans_len_right
,left_window_shape[],right_window_shape[]) {

    for (i=0;i<first_pos;i++)
        z[i] = 0.;
    for (i=last_pos+1;i<N_f;i++)
        z[i] = 0.;

    tr_scale = 0.5*n_long/warped_trans_len_left*OS_FACTOR_WIN;
    tr_pos = (warped_trans_len_left+first_pos-N_f/4)+0.5)*tr_scale;

    for (i=N_f/2-1-first_pos;i>=first_pos;i--) {
        z[i] = X[0][i]*left_window_shape[floor(tr_pos)]);
        tr_pos += tr_scale;
    }

    tr_scale = 0.5*n_long/warped_trans_len_right*OS_FACTOR_WIN;
    tr_pos = (3*N_f/4-last_pos-0.5+warped_trans_len_right)*tr_scale;

    for (i=3*N_f/2-1-last_pos;i<=last_pos;i++) {
        z[i] = X[0][i]*right_window_shape[floor(tr_pos)]);
        tr_pos += tr_scale;
    }
}
```

FIG 15

```
offset_pos=0.5;

num_samples_in = N_f+2*IP_LEN_2S;
num_samples_out = 3*n_long;
j_center = 0;
for (i=0;i<numSamplesOut;i++) {
   while (j_center<num_samples_in && sample_pos[j_center]-offset_pos<=i)
      j_center++;
   j_center--;
   y[i] = 0;
   if (j_center<num_samples_in-1 && j_center>0) {
      frac_time = floor((i-(sample_pos[j_center]-offset_pos))
            /(sample_pos[j_center+1]-sample_pos[j_center])
            *os_factor);
      j = IP_LEN_2S*os_factor+frac_time;

      for (k=j_center-IP_LEN_2S;k<=j_center+IP_LEN_2S;k++) {
         if (k>=0 && k<num_samples_in)
            y[i] += b[abs(j)]*zp[k];
         j -= os_factor;
      }

   }
   if (j_center<0)
      j_center++;
}
```

FIG 16

```
usac_raw_data_block()
{
    single_channel_element ();
    or
    channel_pair_element ();
    or
    single_channel_element ();
    and
    channel_pair_element ();
}
```

FIG 17A

```
single_channel_element ()
{
    fd_channel_stream (*,*,*);
}
```

FIG 17B

```
channel_pair_element
{
if (tw_mdct) {
    common_tw;
    if (common_tw) {
        tw_data();
    }
}
fd_channel_steram(*,*,*);
fd_channel_steram(*,*,*);
}
```

FIG 17C

```
fd_channel_stream (*,*,*);
{
    global gain;
    if (tw_mdct) {
        if (not common_tw) {
            tw_data ();
        }
    }
    scale_factor_data ();
    ac_spectral_data ();
}
```

FIG 17D

Table - Syntax of tw_data()

| syntax | no. of bits | mnemonic |
|---|---|---|
| tw_data() | | |
| { | | |
| **tw_data_present;** | **1** | **uimsbf** |
| if (tw_data_prsent==1) { | | |
| for (i=1; i<NUM_TW_NODES; i++) { | | |
| **tw_ratio[i];** | **3** | **uimsbf** |
| } | | |
| } | | |
| } | | |

FIG 17E

Table - Syntax of ac_spectral_data()

| syntax | no. of bits | mnemonic |
|---|---|---|
| ac_spectral_data(indepFlag) | | |
| { | | |
| if(indepflag) { | | |
| arith_reset_flag=1; | | |
| } else { | | |
| **arith_reset_flag;** | **1** | **uimsbf** |
| } | | |
| for (win=0; win<num_windows; win++) { | | Note 1 |
| arith_data(lg, arith_reset_flag && (win==0)); | | |
| } | | |
| } | | |

Note 1: num_windows indicates the number of windows in the current window_sequence. In case window_sequence is EIGHT_SHORT_SEQUENCE num_windows equals 8. In all other cases num_windows equals 1

FIG 17F

AUDIO SIGNAL DECODER, AUDIO SIGNAL ENCODER, METHODS AND COMPUTER PROGRAM USING A SAMPLING RATE DEPENDENT TIME-WARP CONTOUR ENCODING

CROSS-REFERENCE TO RELATED APPLICATIONS

This application is a continuation of copending International Application No. PCT/EP2011/053538, filed Mar. 9, 2011, which is incorporated herein by reference in its entirety, and additionally claims priority from U.S. Application No. 61/312,503, filed Mar. 10, 2010, which is also incorporated herein by reference in its entirety.

BACKGROUND OF THE INVENTION

Embodiments according to the invention are related to an audio signal decoder. Further embodiments according to the invention are related to an audio signal encoder. Further embodiments according to the invention are related to a method for decoding an audio signal, to a method for encoding an audio signal and to a computer program.

Some embodiments according to the invention are related to a sampling frequency dependent pitch variation quantization.

In the following, a brief introduction will be given into the field of time-warped audio encoding, concepts of which can be applied in conjunction with some of the embodiments of the invention.

In the recent years, techniques have been developed to transform an audio signal to a frequency-domain representation, and to efficiently encode the frequency-domain representation, for example, by taking into account perceptual masking thresholds. This concept of audio signal encoding is particularly efficient if the block length, for which a set of encoded spectral coefficients are transmitted, is long, and if only a comparatively small number of spectral coefficients are well above the global masking threshold while a large number of spectral coefficients are nearby or below the global masking threshold and can thus be neglected (or coded with minimum code length). A spectrum in which said condition holds is sometimes called a sparse spectrum.

For example, cosine-based or sine-based modulated lapped transforms are often used in applications for source coding due to their energy compaction properties. That is, for harmonic tones with constant fundamental frequencies (pitch), they concentrate the signal energy to a low number of spectral components (sub-bands), which leads to an efficient signal representation.

Generally, the (fundamental) pitch of a signal shall be understood to be the lowest dominant frequency distinguishable from the spectrum of the signal. In the common speech model, the pitch is the frequency of the excitation signal modulated by the human throat. If only one single fundamental frequency would be present, the spectrum would be extremely simple, comprising the fundamental frequency and the overtones only. Such a spectrum could be encoded highly efficiently. For signals with varying pitch, however, the energy corresponding to each harmonic component is spread over several transform coefficients, thus leading to a reduction of coding efficiency.

In order to overcome the reduction of coding efficiency, the audio signal to be encoded is effectively resampled on a non-uniform temporal grid. In the subsequent processing, the sample positions obtained by the non-uniform resampling are processed as if they would represent values on a uniform temporal grid. This operation is commonly denoted by the phrase "time warping". The sample times may be advantageously chosen in dependence on the temporal variation of the pitch, such that a pitch variation in the time warped version of the audio signal is smaller than a pitch variation in the original version of the audio signal (before time warping). After time warping of the audio signal, the time-warped version of the audio signal is converted into the frequency-domain. The pitch-dependent time warping has the effect that the frequency-domain representation of the time-warped audio signal typically exhibits an energy compaction into a much smaller number of spectral components than a frequency-domain representation of the original (non-time-warped audio signal).

At the decoder side the frequency-domain representation of the time-warped audio signal is converted to the time-domain, such that a time-domain representation of the time-warped audio signal is available at the decoder side. However, in the time-domain representation of the decoder-sided reconstructed time-warped audio signal, the original pitch variations of the encoder-sided input audio signal are not included. Accordingly, yet another time warping by resampling of the decoder-sided reconstructed time-domain representation of the time-warped audio signal is applied.

In order to obtain a good reconstruction of the encoder-sided input audio signal at the decoder, it is desirable that the decoder-skied time warping is at least approximately the inverse operation with respect to the encoder-sided time warping. In order to obtain an appropriate time warping, it is desirable to have an information available at the decoder, which allows for an adjustment of the decoder-sided time warping.

As it is typically necessitated to transfer such an information from the audio signal encoder to the audio signal decoder, it is desirable to keep the bitrate necessitated for this transmission small while still allowing for a reliable reconstruction of the necessitated time warp information at the decoder side.

In view of this situation, there is a desire to have a concept which allows for a reliable reconstruction of a time-warp information on the basis of an efficiently encoded representation of the time-warp information.

SUMMARY

According, to an embodiment, an audio signal decoder configured to provide a decoded audio signal representation on the basis of an encoded audio signal representation including a sampling frequency information, an encoded time warp information (tw_ratio[i]) and an encoded spectrum representation (ac_spectral_data( )), may have: a time warp calculator configured to map the encoded time warp information (tw_ratio[i]) onto a decoded time warp information (warp_value_tbl [tw_ratio], $p_{rel}$), wherein the time warp calculator is configured to adapt a mapping rule for mapping codewords (tw_ratio[i], index) of the encoded time warp information onto decoded time warp values (warp_value_tbl[tw_ratio], $p_{rel}$) describing the decoded time warp information in dependence on the sampling frequency information; and a warp decoder configured to provide the decoded audio signal representation on the basis of the encoded spectrum representation (ac_spectral_data( )) and in dependence on the decoded time warp information.

According to another embodiment, an audio signal encoder for providing an encoded representation of an audio signal may have: a time warp contour encoder configured to map time warp values ($p_{rel}$) describing a time warp contour onto an encoded time warp information, wherein the time warp contour encoder is configured to adapt a mapping rule for mapping the time warp values ($p_{rel}$) describing the time warp contour onto codewords (tw_ratio[i], index) of the encoded time warp information in dependence on a sampling frequency ($f_s$) of the audio signal; and a time warping signal encoder configured to obtain an encoded representation of a spectrum of the audio signal, taking into account as time warp described by the time warp contour information wherein the encoded representation of the audio signal includes the codeword (tw_ratio[i], index) of the encoded time warp information, the encoded representation of the spectrum and a sampling frequency information describing the sampling frequency.

According to another embodiment, a method for providing a decoded audio signal representation on the basis of an encoded audio signal representation including a sampling frequency information, an encoded time warp information and an encoded spectrum representation, may have the steps of: mapping the encoded time warp information onto a decoded time warp information, wherein a mapping rule for mapping codewords of the encoded time warp information onto decoded time warp values describing the decoded time warp information is adapted in dependence on the sampling frequency information; and providing the decoded audio signal representation on the basis of the encoded spectrum representation and in dependence on the decoded time warp information.

According to another embodiment, a method for providing an encoded representation of an audio signal may have the steps of: mapping time warp values describing a time warp contour onto an encoded time warp information, wherein a mapping rule for mapping the time warp values describing the time warp contour onto codewords of the encoded time warp information is adapted in dependence on a sampling frequency of the audio signal; obtaining an encoded representation of as spectrum of the audio signal, taking into account a time warp described by the time warp contour information; wherein the encoded representation of the audio signal includes the codewords of the encoded time warp information, the encoded representation of the spectrum and a sampling frequency information describing the sampling frequency.

Another embodiment may have a computer program for performing the inventive method when the computer program runs on the computer.

An embodiment according to the invention creates an audio decoder configured to provide a decoded audio signal representation on the basis of an encoded audio signal representation comprising a sampling frequency information, an encoded time warp information and an encoded spectrum representation. The audio signal decoder comprises a time warp calculator (which may, for example, take the function of a time warp decoder) and a warp decoder. The time warp calculator is configured to map the encoded time warp information onto a decoded time warp information. The time warp calculator is configured to adapt a mapping rule for mapping codewords of the encoded time warp information onto decoded time warp values describing the decoded time warp information in dependence on the sampling frequency information. The warp decoder is configured to provide the decoded audio signal representation on the basis of the encoded spectrum representation and in dependence on the decoded time warp information.

This embodiment according to the invention is based on the finding that a time warp (which is, for example, described by a time warp contour) can be efficiently encoded if the mapping rule for mapping codewords of the encoded time warp information onto decoded time warp values is adapted to the sampling rate because it has been found that it is desirable to represent a larger time warp per sample for lower sampling frequencies than for higher sampling frequencies. It has been found that this desire arises from the fact that it is advantageous if a time warp per time unit, which is representable by the set of codewords of the encoded time warp information, is approximately independent from the sampling frequency, which translates into the consequence that a time warp representable by a given set of codewords should be larger for smaller sampling frequencies than for higher sampling frequencies under the assumption that the number of time warp codewords per audio sample (or per audio frame) remains at least approximately constant independent from the actual sampling frequency.

To summarize, it has been found that it is advantageous to adapt the mapping rule for mapping codewords of the encoded time warp information (also briefly designated as time warp codewords) onto decoded time warp values in dependence on the sampling frequency of the encoded audio signal (represented by the encoded audio signal representation), because this allows to represent the relevant time warp values using a small (and consequently bitrate-efficient) set of time warp codewords both for the case of a comparatively high sampling frequency and for the case of a comparatively low sampling frequency.

By adapting the mapping rule, it is possible to encode a comparatively smaller range of time warp values using a higher resolution for a comparatively high sampling frequency, and to encode a comparatively larger range of time warp values with a coarser resolution for a comparatively small sampling frequency, which in turn brings along a very good bitrate efficiency.

In an embodiment, the codewords of the encoded time warp information describe a temporal evolution of a time warp contour. The time warp calculator is configured to evaluate a predetermined number of codewords of the encoded time warp information for an audio frame of an encoded audio signal represented by the encoded audio signal representation. The predetermined number of codewords is independent of a sampling frequency of the encoded audio signal. Accordingly, it can be achieved that a bitstream format remains substantially independent of the sampling frequency while it is still possible to efficiently encode the time warp. By using a predetermined number of time warp codewords for an audio frame of the encoded audio signal, wherein the predetermined number is independent of the sampling frequency of the encoded audio signal, the bitstream format does not change with the sampling frequency and the bitstream parser of an audio decoder does not need to be adjusted to the sampling frequency. However, an efficient encoding of the time warp is still achieved by the adaptation of the mapping rule for mapping codewords of the encoded time warp information onto decoded time warp values, because the mapping of the time warp codewords onto decoded time warp values can be adapted to the sampling frequency such that a representable range of time warp values brings along a good compromise between resolution and maximum encodeable time warp for different sampling frequencies.

In an embodiment, the time warp calculator is configured to adapt the mapping rule such that a range of decoded time warp values onto which codewords of a given set of codewords of the encoded time warp information are mapped, is larger for a first sampling frequency than for a second sampling frequency provided the first sampling frequency is smaller than the second sampling frequency. Accordingly, the same codewords, which encode a comparatively smaller range of time warp values for a comparatively high sampling frequency encode a comparatively larger range of time warp values for a comparatively smaller sampling frequency. Thus, it can be ensured that it is possible to encode approximately the same time warp per time unit (defined, for example, in octaves per second, briefly designated with "oct/s") for a high sampling frequency and a low sampling frequency, even though more time warp codewords are transmitted per time unit for a comparatively higher sampling frequency than for a comparatively lower sampling frequency.

In an embodiment, the decoded time warp values are time warp contour values representing values of a time warp contour or time warp contour variation values representing a change of values of a time warp contour.

In an embodiment, the time warp calculator is configured to adapt the mapping rule such that a maximum change of pitch over a given number of samples, which is representable by a given set of codewords of the encoded time warp information, is larger for a first sampling frequency than for a second sampling frequency provided the first sampling frequency is smaller than the second sampling frequency. Accordingly, the same set of codewords is used for describing different ranges of decoded time warp values, which is very well-adapted to the different sampling frequencies.

In an embodiment, the time warp calculator is configured to adapt the mapping rule such that a maximum change of pitch over a given time period, which is representable by a given set of codewords of the encoded time warp information at a first sampling frequency, differs from a maximum change of pitch over the given time period, which is representable by the given set of codewords of the encoded time warp information at a second sampling frequency, by no more than 10% for a first sampling frequency and a second sampling frequency differing by at least 30%. Accordingly, the fact that a given set of codewords would conventionally represent a significantly different time warp per time unit for different sampling frequencies is avoided, in accordance with the present invention, by the adaptation of the mapping rule. Thus, a number of different codewords can be kept reasonably small, which results in a good coding efficiency, wherein the resolution for the encoding of the time warp is nevertheless adapted to the sampling frequency.

In an embodiment, the time warp calculator is configured to use different mapping tables for mapping codewords of the encoded time warp information onto decoded time warp values in dependence on the sampling frequency information. By providing different mapping tables, the decoding mechanism can be kept very simple at the expense of the memory requirements.

In another embodiment, the time warp calculator is configured to adapt a (reference) mapping rule, which describes decoded time warp values associated with different codewords of the encoded time warp information for a reference sampling frequency, to an actual sampling frequency different from the reference sampling frequency. Accordingly, a memory demand can be kept small because it is only necessitated to store the mapping values (i.e. decoded time warp values) associated with a set of different codewords for a single reference sampling frequency. It has been found that it is possible with small computational effort to adapt the mapping values to a different sampling frequency.

In an embodiment, the time warp calculator is configured to scale a portion of the mapping values, which portion describes a time warp, in dependence on a ratio between the actual sampling frequency and the reference sampling frequency. It has been found that such a linear scaling of a portion of the mapping values constitutes a particularly efficient solution for obtaining the mapping values for different sampling frequencies.

In an embodiment, the decoded time warp values describe a variation of a time warp contour over a predetermined number of samples of the encoded audio signal represented by the encoded audio signal representation. In this case, the time warp calculator is configured to combine a plurality of decoded time warp values which represent a variation of the time warp contour, to derive a warp contour node value, such that a deviation of the derived warp node value from a reference warp node value is larger than a deviation representable by a single one of the decoded time warp values. By combining a plurality of decoded time warp values, it is possible to maintain a range necessitated for an individual time warp values sufficiently small. This increases the coding efficiency of the time warp values. At the same time, it is possible to adjust the range of representable time warps by adapting the mapping rule.

In an embodiment, the encoded time warp values describe a relative change of the time warp contour over a predetermined number of samples of the encoded audio signal represented by the encoded audio signal representation. In this case, the time warp calculator is configured to derive the decoded time warp information from the decoded time warp values, such that the decoded time warp information describes the time warp contour. A combination of a use of time warp values, which describe a relative change of the time warp contour over a predetermined number of samples of the encoded audio signal, with an adaptation of a mapping rule for mapping codewords of the encoded time warp information onto decoded time warp values brings along a high coding efficiency, because it can be ensured that a substantially identical, or at least similar range of time warp (in terms of oct/s) can be encoded for different sampling frequencies, even though the number of time warp codewords per sample of the encoded audio signal can be kept constant in the case of a change of the sampling frequency.

In an embodiment, the time warp calculator is configured to compute supporting points of a time warp contour on the basis of the decoded time warp values. In this case, the time warp calculator is configured to interpolate between the supporting points to obtain the time warp contour as the decoded time warp information. In this case, a number of decoded time warp values per audio frame is predetermined and independent from the sampling frequency. Accordingly, the interpolation scheme between the supporting points may be left unchanged, which helps to keep the computational complexity small.

An embodiment according to the invention creates an audio signal encoder for providing an encoded representation of an audio signal. The audio signal encoder comprises a time warp contour encoder configured to map time warp values describing a time warp contour onto an encoded time warp information. The time warp contour encoder is configured to adapt a mapping rule for mapping the time warp values describing the time warp contour onto the codewords of the encoded time warp information in dependence on a sampling frequency of the audio signal. The audio signal encoder also comprises a time warping signal encoder configured to obtain an encoded representation of a spectrum of the audio signal, taking into account a time warp described by the time warp contour information. In this case, the encoded representation of the audio signal comprises the codewords of the encoded time warp information, the encoded representation of the spectrum and a sampling frequency information describing the sampling frequency. Said audio encoder is well-suited for providing the encoded audio signal representation which is used by the above-discussed audio signal decoder. Moreover, the audio signal encoder brings along the same advantages which have been discussed above with respect to the audio signal decoder and is based on the same considerations.

Another embodiment according to the invention creates a method for providing a decoded audio signal representation on the basis of an encoded audio signal representation.

Another embodiment according to the invention creates a method for providing an encoded representation of an audio signal.

Another embodiment according to the invention creates a computer program for implementing one or both of said methods.

BRIEF DESCRIPTION OF THE DRAWINGS

Embodiments of the present invention will be detailed subsequently referring to the appended drawings, in which:

FIG. 3*b* shows a block schematic diagram of an audio signal decoder, according to another embodiment of the present invention;

FIG. 4*c* shows a table representation of warps of a conventional quantization scheme;

FIG. 4*d* shows a table representation of a mapping of codeword indices onto decoded time warp values for different sampling frequencies, according to an embodiment of the invention;

FIG. 4*e* shows a table representation of a mapping of codeword indices onto decoded time warp values for different sampling frequencies, according to another embodiment of the invention;

FIG. 7*a* shows a legend of definitions of data elements and help elements, which are used in an audio decoder according to an embodiment of the invention;

FIG. 7*b* shows a legend of definitions of constants, which are used in an audio decoder according to an embodiment of the invention;

FIG. 8 shows a table representation of a mapping of a codeword index onto a corresponding decoded time warp value;

FIG. 9 shows a pseudo program code representation of an algorithm for interpolating linearly between equally spaced warp nodes;

FIG. 10*a* shows a pseudo program code representation of a helper function "warp_time_inv";

FIG. 10*b* shows a pseudo program code representation of a helper function "warp_inv_vec";

FIG. 11 shows a pseudo program code representation of an algorithm for computing a sample position vector and a transition length;

FIG. 12 shows a table representation of values of a synthesis window length N depending on a window sequence and a core coder frame length;

FIG. 13 shows a matrix representation of allowed window sequences;

FIG. 14 shows a pseudo program code representation of an algorithm for windowing and for an internal overlap-add of a window sequence of type "EIGHT_SHORT_SEQUENCE";

FIG. 15 shows a pseudo program code representation of an algorithm for the windowing and the internal overlap-and-add of other window sequences, which are not of type "EIGHT_SHORT_SEQUENCE";

FIG. 16 shows a pseudo program code representation of an algorithm for resampling; and FIGS. 17*a*-17*f* show representations of syntax elements of the audio stream, according to an embodiment of the invention.

DETAILED DESCRIPTION OF THE INVENTION

1. Time Warp Audio Signal Encoder According to FIG. 1

Figure 1:
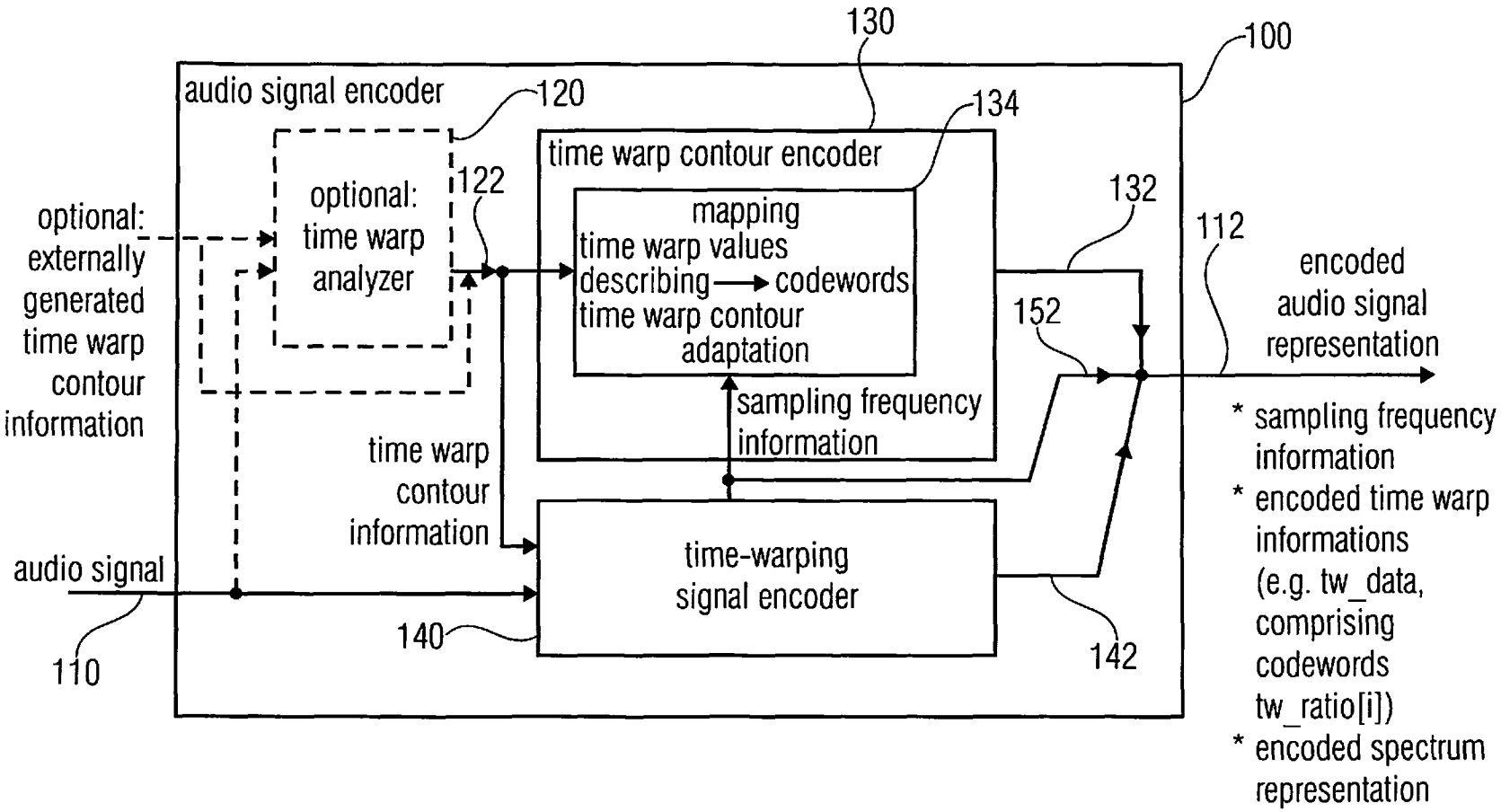
FIG. 1 shows a block schematic diagram of an audio signal encoder, according to an embodiment of the present invention.

FIG. 1 shows a block schematic diagram of a time warp audio signal encoder 100 according to an embodiment of the invention.

The audio signal encoder 100 is configured to receive an input audio signal 110 and, to provide, on the basis thereof, an encoded representation 112 of the input audio signal 110. The encoded representation 112 of the input audio signal 110 comprises, for example, an encoded spectrum representation, an encoded time warp information (which may be designated, for example, with "tw_data", and which may, for example, comprise codewords tw_ratio[i]) and a sampling frequency information.

The audio signal encoder may optionally comprise a time warp analyzer 120, which may be configured to receive the input audio signal 110, to analyze the input audio signal and to provide a time warp contour information 122, such that the time warp contour information 122 describes, for example, a temporal evolution of the pitch of the audio signal 110. However, the audio signal encoder 100 may, alternatively, receive a time warp contour information provided by a time warp analyzer which is external to the audio signal encoder.

The audio signal encoder 100 also comprises a time warp contour encoder 130, which is configured to receive the time warp contour information 122, and to provide, on the basis thereof, the encoded time warp information 132. For example, the time warp contour encoder 130 may receive time warp values describing the time warp contour. The time warp values may, for example, describe absolute values of a normalized or non-normalized time warp contour or relative changes over time of normalized or non-normalized time warp contour. Generally speaking, the time warp contour encoder 130 is configured to map time warp values describing the time warp contour 122 onto the encoded time warp information 132.

The time warp contour encoder 130 is configured to adapt a mapping rule for mapping the time warp values describing the time warp contour onto codewords of the encoded time warp information 132 in dependence on a sampling frequency of the audio signal. For this purpose, the time warp contour encoder 130 may receive a sampling frequency information, to thereby adapt said mapping 134.

The audio signal encoder 100 also comprises a time warping signal encoder 140, which is configured to obtain an encoded representation 142 of a spectrum of the audio signal 110, taking into account a time warp described by the time warp contour information 122.

Consequently, the encoded audio signal representation 112 may be provided, for example, using a bitstream provider, such that the encoded representation 112 of the audio signal 110 comprises the codewords of the encoded time warp information 132, the encoded representation 142 of the spectrum and a sampling frequency information 152 describing the sampling frequency (for example, the sampling frequency of the input audio signal 110 and/or the (average) sampling frequency used by the time warping signal encoder 140 in context with the time-domain-to-frequency-domain conversion).

Regarding the functionality of the audio signal encoder 100, it can be said that the spectrum of an audio signal, which changes its pitch during an audio frame (wherein a length of an audio frame, in terms of audio samples, may be equal to a transform length of a time-domain-to-frequency-domain transform used by the time warping signal encoder) may be compacted by a time-varying re-sampling. Accordingly, the time-varying re-sampling, which may be performed by the time warping signal encoder 140 in dependence on the time warp contour information 122, results in a spectrum (of the re-sampled audio signal) which can be encoded with better bitrate-efficiency than the spectrum of the original input audio signal 110.

Figure 2:
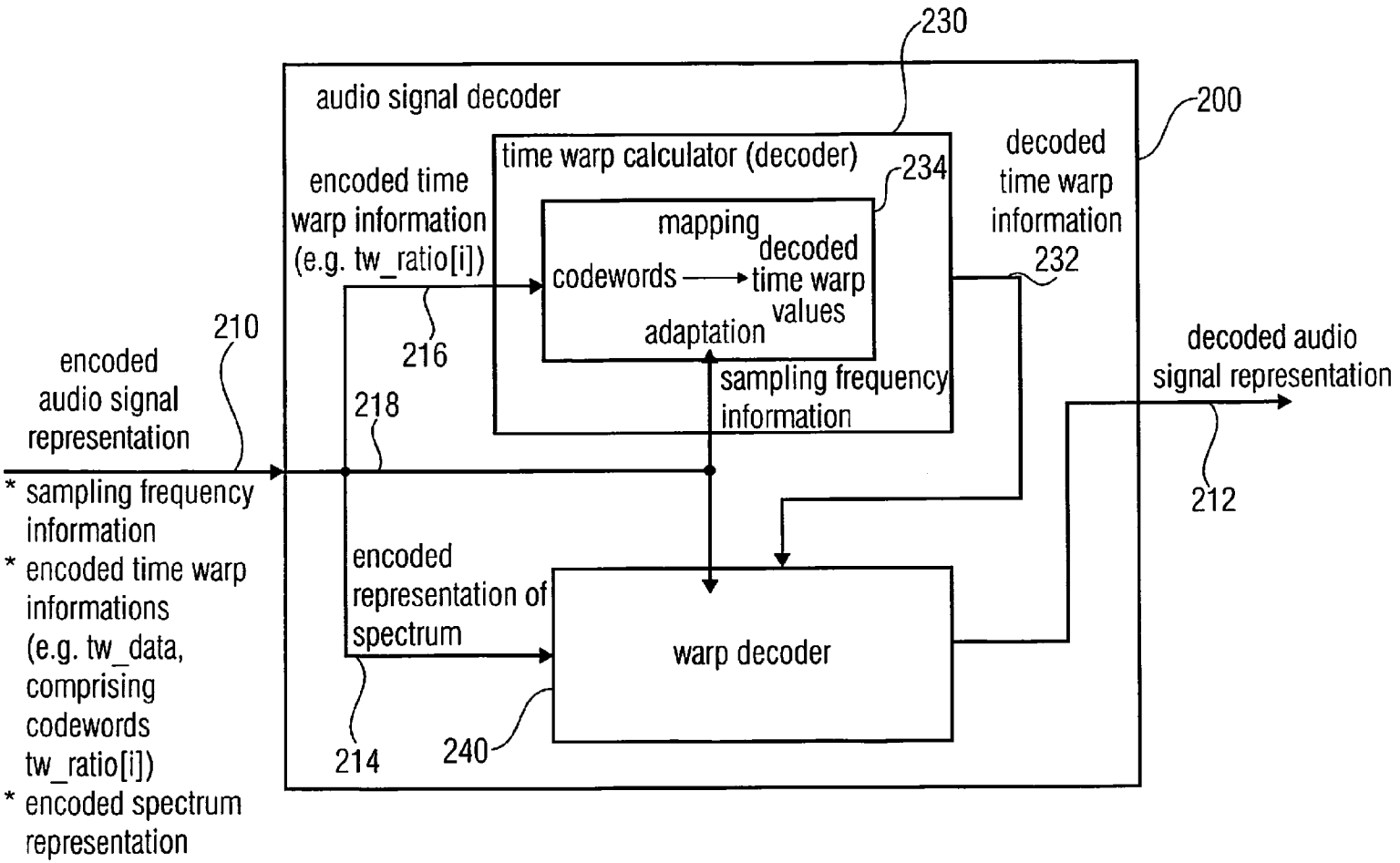
FIG. 2 shows a block schematic diagram of an audio signal decoder, according to an embodiment of the present invention.

However, the time warp which is applied in the time warping signal encoder 140 is signaled to an audio signal decoder 200 according to FIG. 2 using the encoded time warp information. Moreover, the encoding of the time warp information, which may comprise a mapping of the time warp values onto codewords, is adapted in dependence on the sampling frequency information, such that different mappings of the time warp values onto the codewords are used for different sampling frequencies of the input audio signal 110 or for different sampling frequencies at which the time warping signal encoder 140 (or the time-domain-to frequency-domain conversion thereof) is operated.

Thus, the most bitrate-efficient mapping may be chosen for each of the possible sampling frequencies, which can be handled by the time warping signal encoder 140. Such an adaptation makes sense because it was found that a bitrate of the encoded time warp information can be kept small even in case of multiple possible sampling frequencies used by the time warping signal encoder 140 if the mapping of the time warp values describing the time warp contour onto the codewords matches the current frequency. Accordingly, it can be ensured that a small set of different codewords is sufficient for encoding the time warp contour with sufficiently fine resolution and also with sufficiently large dynamic range, both in the case of comparatively small sampling frequencies and comparatively large sampling frequencies, even if a number of codewords per audio frame remains constant over different sampling frequencies (which, in turn, provides for a sampling frequency independent bitstream and therefore facilitates the generation, storage, parsing and on-the-fly-processing of the encoded audio signal representation 112).

Further details regarding the adaptation of the mapping 134 will be discussed below.

2. Time Warp Audio Signal Decoder According to FIG. 2

FIG. 2 shows a block schematic diagram of a time warp audio signal decoder 200, according to an embodiment of the invention.

The audio signal decoder 200 is configured to provide a decoded audio signal representation 212 (for example, in the form of a time-domain audio signal representation) on the basis of an encoded audio signal representation 210. The encoded audio signal representation 210 may, for example, comprise an encoded spectrum representation 214 (which may be equal to the encoded spectrum representation 142 provided by the time warping audio signal encoder 140), an encoded time warp information 216 (which may, for example, be equal to the encoded time warp information 132 provided by the time warp contour encoder 130), and a sampling frequency information 218 (which may, for example, be equal to the sampling frequency information 152).

The audio signal decoder 200 comprises a time warp calculator 230, which may also be considered as a time warp decoder. The time warp calculator 230 is configured to map the encoded time warp information 216 onto a decoded time warp information 232. The encoded time warp information 216 may, for example, comprise time warp codewords "tw_ratio[i]", and the decoded time warp information may, for example, take the form of a time warp contour information describing a time warp contour. The time warp calculator 230 is configured to adapt a mapping rule 234 for mapping (time warp) codewords of the encoded time warp information 216 onto decoded time warp values describing the decoded time warp information in dependence on the sampling frequency information 218. Accordingly, different mappings of codewords of the encoded time warp information 216 onto time warp values of the decoded time warp information 232 may be chosen for different sampling frequencies signaled by the sampling frequency information.

The audio signal decoder 200 also comprises a warp decoder 240 which is configured to receive the encoded representation 214 of the spectrum and to provide the decoded audio signal representation 212 on the basis of the encoded spectrum representation 214 and in dependence on the decoded time warp information 232.

Accordingly, the audio signal decoder 200 allows for an efficient decoding of the encoded time warp information, both for a comparatively high sampling frequency and for a comparatively low sampling frequency, because the mapping of codewords of the encoded time warp information onto decoded time warp values is dependent on the sampling frequency. Thus, it is possible to obtain a high resolution of the time warp contour for a comparatively high sampling frequency while still covering a sufficiently large time warp per time unit for comparatively small sampling frequencies, and while using the same set of codewords both for a comparatively small sampling frequency and a comparatively high sampling frequency. Thus, the bitstream format is substantially independent from the sampling frequency, while it is still possible to describe the time warp with appropriate accuracy and dynamic range, both in case of a comparatively high sampling frequency and a comparatively small sampling frequency.

Further details regarding the adaptation of the mapping 234 will be described below. Also, further details regarding the warp decoder 240 will be described below.

3. Time Warp Audio Signal Encoder According to FIG. 3*a*

Figure 3A:
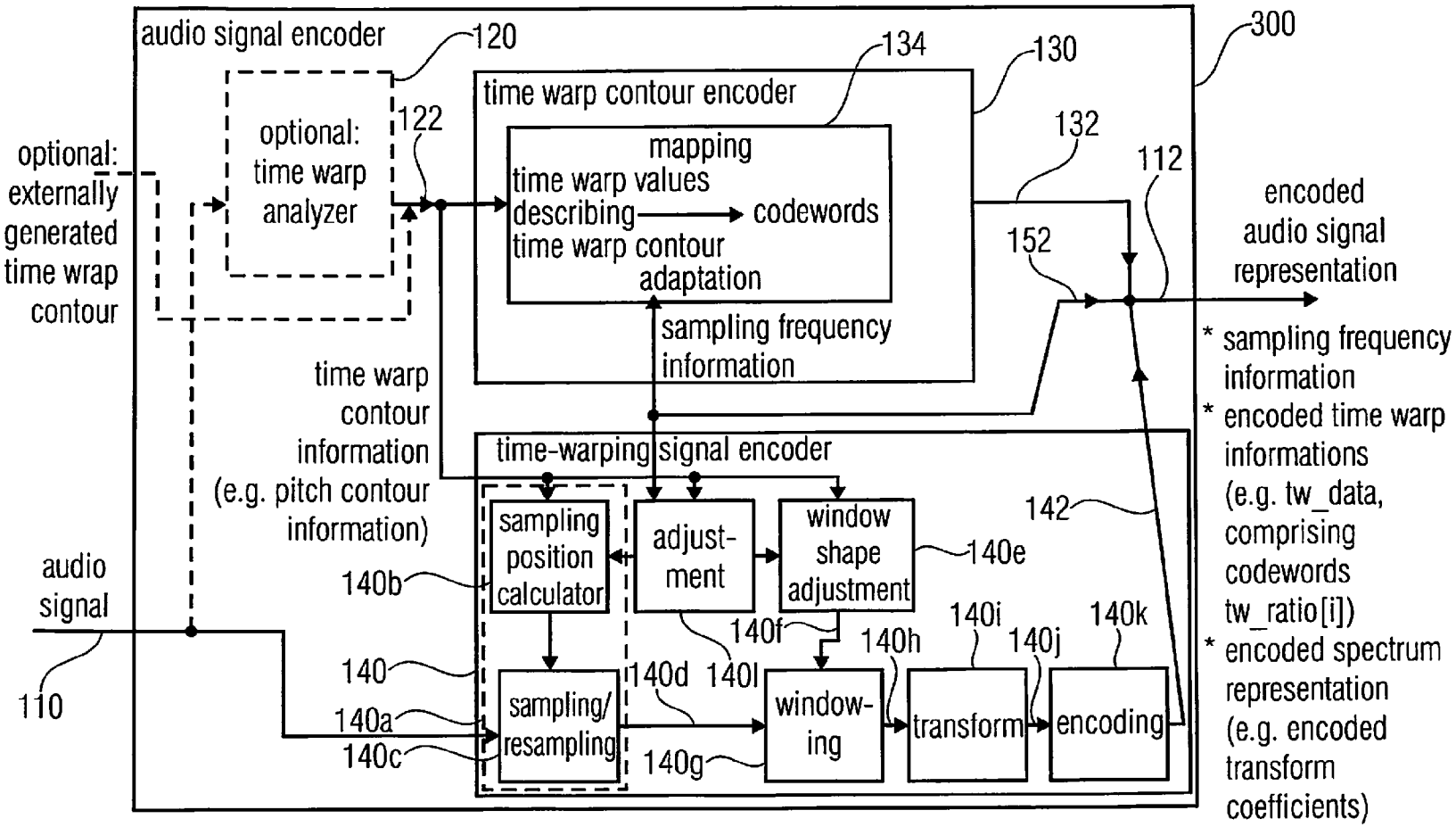
FIG. 3*a* shows a block schematic diagram of an audio signal encoder, according to another embodiment of the present invention.

FIG. 3*a* shows a block schematic diagram of a time warp audio signal encoder 300, according to an embodiment of the invention.

The audio signal encoder 300 according to FIG. 3 is similar to the audio signal encoder 100 according to FIG. 1, such that identical signals and devices are designated as identical reference numerals. However, FIG. 3*a* shows more details regarding the time warp signal encoder 140.

As the present invention is related to a time warp audio encoding and time warp audio decoding, a short overview of details of the time warping audio signal encoder 140 will be given. The time warping audio signal encoder 140 is configured to receive an input audio signal 110 and to provide an encoded spectrum representation 142 of the input audio signal 110 for a sequence of frames. The time warping audio signal encoder 140 comprises a sampling unit or re-sampling unit 140*a*, which is adapted to sample or re-sample the input audio signal 110 to derive signal blocks (sampled representations) 140*d* used as a basis for a frequency domain transform. The sampling unit/re-sampling unit 140*a* comprises a sampling position calculator 140*b*, which is configured to compute sample positions which are adapted to the time warp described by the time warp contour information 122, and which are therefore non-equidistant in time if the time warp (or pitch variation, or fundamental frequency variation) is different from zero. The sampling unit or re-sampling unit 140*a* also comprises a sampler or re-sampler 140*c*, which is configured to sample or re-sample a portion (for example, an audio frame) of the input audio signal 110 using the temporally non-equidistant sample positions obtained by the sampling position calculator.

The time warping audio signal encoder 140 further comprises a transform window calculator 140*e*, which is adapted to derive scaling windows for the sampled or re-sampled representations 140*d* output by the sampling unit or re-sampling unit 140*a*. The scaling window information 140*f* and the sampled/re-sampled representations 140*d* are input into a windower 140*g*, which is adapted to apply the scaling windows described by the scaling window information 140*f* to the corresponding sampled or re-sampled representations 140*d* derived by the sampling unit/re-sampling unit 140*a*. In other embodiments, the time warping audio signal encoder 140 may additionally comprise a frequency-domain transformer 140*i*, in order to derive a frequency-domain representation 140*j* (for example, in the form of transform coefficients or spectral coefficients) of the sampled and windowed representation 140*h* of the input audio signal 110. The frequency-domain representation 140*j* may, for example, be post-processed. Moreover, the frequency-domain representation 140*j*, or a post-processed version thereof, may be encoded using an encoding 140*k* to obtain the encoded spectrum representation 142 of the input audio signal 110.

The time warping audio signal encoder 140 further uses a pitch contour of the input audio signal 110, wherein the pitch contour may be described by a time warp contour information 122. The time warp contour information 122 may be provided to the audio signal encoder 300 as an input information, or may be derived by the audio signal encoder 300. The audio signal encoder 300 may therefore, optionally, comprise a time warp analyzer 120, which may operate as a pitch estimator for deriving the time warp contour information 122, such that the time warp contour information 122 constitutes a pitch contour information or describes the pitch contour or a fundamental frequency.

The sampling unit/re-sampling unit 140*a* may operate on a continuous representation of the input audio signal 110. Alternatively, however, the sampling unit/re-sampling unit 140*a* may operate on a previously sampled representation of the input audio signal 110. In the former case, the unit 140*a* may sample the input audio signal (and may therefore be considered a sampling unit), and in the latter case, the unit 140*a* may resample the previously sampled representation of the input audio signal 110 (an may therefore be considered a re-sampling unit). The sampling unit 140*a* may, for example, be adapted to time warp neighboring overlapping audio blocks such that the overlapping portion has a constant pitch or reduced pitch variation within each of the input blocks after the sampling or re-sampling.

The transform window calculator 140*e* may, optionally, derive the scaling windows for the audio blocks (for example, for the audio frames) depending on the time warping performed by the sampler 140*a*. To this end, an optional adjustment block 140*l* may be present in order to define the warping rule used by the sampler, which is then also provided to the transform window calculator 140*e*.

In an alternative embodiment, the adjustment block 140*l* may be omitted and the pitch contour described by the time warp contour information 122 may be directly provided to the transform window calculator 140*e*, which may itself perform the appropriate calculations. Furthermore, the sampling unit/re-sampling unit 140*a* may communicate the applied sampling to the transform window calculator 140*e* in order to enable the calculation of appropriate scaling windows.

However, in some other embodiments, the windowing may be substantially independent from details of the time warping.

The time warping is performed by the sampling unit/re-sampling unit 140*a* such that a pitch contour of sampled (or re-sampled) audio blocks (or audio frames) time-warped and sampled (or re-sampled) by the unit 140*a* is more constant than the pitch contour of the original input audio signal 110. Accordingly, a smearing of the spectrum, which is caused by a temporal variation of the pitch contour, is reduced by sampling or resampling performed by the unit 140*a*. Thus, the spectrum of the sampled or re-sampled audio signal 140*d* is less smeared (and, typically, shows more explicit spectral peaks and spectral valleys) than the spectrum of the input audio signal 110. Accordingly, it is typically possible to encode the spectrum of the sampled (or resampled) audio signal 140*d* using a smaller bitrate when compared to a bitrate which would be necessitated for encoding the spectrum of the input audio signal 110 with the same accuracy.

It should be noted here that the input audio signal 110 is typically processed frame-wise, wherein the frames may be overlapping or non-overlapping depending on the specific requirements. For example, each of the frames of the input audio signal may be sampled or re-sampled individually by the unit 140*a*, to thereby obtain a sequence of sampled (or re-sampled) frames described by respective sets of time-domain samples 140*d*. Also, the windowing may be applied individually to the sampled or re-sampled frames, represented by respective sets of time domain samples 140*d*, by the windowing 140*g*. Moreover, the windowed and re-sampled frames, described by respective sets of windowed and re-sampled time domain samples 140*h*, may be transformed individually into a frequency-domain by the transform 140*i*. Nevertheless, there may be some (temporal) overlapping of the individual frames.

Moreover, it should be noted that the audio signal 110 may be sampled with a predetermined sampling frequency (also designated as a sampling rate). In the re-sampling, which is performed by the sampler or re-sampler 140*c*, the re-sampling may be performed such that a re-sampled block (or frame) of the input audio signal 110 may comprise an average sampling frequency (or sampling rate) which is identical (or at least approximately identical, for example within a tolerance of +/−5%) to the sampling frequency (or sampling rate) of the input audio signal 110. However, the audio signal encoder 300 may, alternatively, be configured to operate with input audio signals of different sampling frequencies (or sampling rates).

Accordingly, the average sampling frequency (or sampling rate) of the re-sampled blocks or frames, represented by time-domain samples 140*d*, may vary in dependence on the sampling frequency or sampling rate of the input audio signal 110 in some embodiments.

However, it is naturally also possible that the average sampling frequency or sampling rate of the blocks or frames of the sampled or re-sampled audio signal, represented by the time domain samples 140*d*, differs from the sampling rate of input audio signal 110, because the sampler 140*a* may perform both, a sampling rate conversion, in accordance with an operator's desires or requirements, and a time warping.

Consequently, it can be said that the blocks or frames of the sampled or re-sampled audio signal, represented by sets of time domain samples 140*d*, may be provided at different sampling frequencies or sampling rates, depending on an average sampling frequency or sampling rate of the input audio signal 110 and/or users' desires.

However, in some embodiments, a length of the blocks or frames of the sampled or re-sampled audio signal represented by sets of spectral values 140*d*, in terms of audio samples, may be constant even for different average sampling frequencies or sampling rates. However, switching between two possible lengths (in terms of audio samples per block or frame) may take place in some embodiments, wherein a block length or frame length in a first (short block) mode may be independent of the average sampling frequency, and wherein a block length or frame length (in terms of audio samples) in a second (long block) mode may be independent of the average sampling frequency or sampling rate as well.

Accordingly, the windowing, which is performed by the windower 140*g*, the transform, which is performed by the transformer 140*i*, and the encoding, which is performed by the encoder 140*k*, may be substantially independent of the average sampling frequency or sampling rate of the sampled or re-sampled audio signal 140*d* (except for a possible switching between a short block mode and a long block mode, which may take place independent of the average sampling frequency or sampling rate).

To conclude, the time warping signal encoder 140 allows to efficiently encode the input audio signal 110 because the sampling or re-sampling performed by the sampler 140*a* results in a re-sampled audio signal 140*d* having a less smeared spectrum than the input audio signal 110 in case the input audio signal 110 comprises a temporal pitch variation, which in turn allows for a bitrate-efficient encoding (by the encoder 140*k*) of the spectral coefficients 140*j* provided by the transformer 140*i* on the basis of the sampled/re-sampled and windowed version 140*h* of the input audio signal 110.

The time-warped contour encoding, which is performed in a sampling-frequency-dependent manner by the time warp contour encoder 130, allows for a bitrate efficient encoding of the time warp contour information 122 for different sampling frequencies (or average sampling frequencies) of the sampled/re-sampled audio signal 140*d*, such that a bitstream comprising the encoded spectrum representation 142 and the encoded time warp information 132 is bitrate-efficient.

4. Time Warp Audio Signal Decoder According to FIG. 3*b*

FIG. 3*b* shows a block schematic diagram of an audio signal decoder 350, according to an embodiment of the invention.

The audio signal decoder 350 is similar to the audio signal decoder 200 according to FIG. 2, such that identical signals and devices will be designated with identical reference numerals and not be explained here again.

The audio signal decoder 350 is configured for receiving an encoded spectrum representation of a first time-warped and sampled audio frame and for also receiving an encoded spectrum representation of a second time-warped and sampled audio frame. Generally speaking, the audio signal encoder 350 is configured for receiving a sequence of encoded spectrum representations of time-warp-resampled audio frames, wherein said encoded spectrum representations may, for example, be provided by the time warping signal encoder 140 of the audio signal encoder 300. In addition, the audio signal decoder 350 receives side information, like, for example, an encoded time warp information 216 and a sampling frequency information 218.

The warp decoder 240 may comprise a decoder 240*a*, which is configured to receive the encoded representation 214 of the spectrum, to decode the encoded representation 214 of this spectrum and to provide a decoded representation 240*b* of the spectrum. The warp decoder 240 also comprises an inverse transformer 240*c* which is configured to receive the decoded representation 240*b* of the spectrum and to perform an inverse transform on the basis of said decoded representation 240*b* of the spectrum, to thereby obtain a time-domain representation 240*d* of a block or frame of the time-warp-sampled audio signal described by the encoded spectrum representation 214. The warp decoder 240 also comprises a windower 240*e*, which is configured to apply a windowing to the time-domain representation 240*d* of a block or frame, to thereby obtain a windowed time-domain representation 240*f* of a block or frame. The warp decoder 240 also comprises a re-sampling 240*g*, in which the windowed time-domain representation 240*f* is re-sampled in accordance with a sampling position information 240*h*, to thereby obtain a windowed and re-sampled time-domain representation 240*i* for a block or a frame. The warp decoder 240 also comprises an overlapper-adder 240*j*, which is configured to overlap-and-add subsequent blocks or frames of the windowed and re-sampled time-domain representation, to thereby obtain a smooth transition between the subsequent blocks or frames of the windowed and re-sampled time-domain representation 240*i*, and to thereby obtain the decoded audio signal representation 212 as a result of the overlap-and-add operation.

The warp decoder 240 comprises a sampling position calculator 240*k*, which is configured to receive the decoded time warp information 232 from the time warp calculator (or time warp decoder) 230, and to provide the sampling position information 240*h* on the basis thereof. Accordingly, the decoded time warp information 232 describes the time-varying re-sampling, which is performed by the re-sampler 240*g*.

Optionally, the warp decoder 240 may comprise a window shape adjuster 240*l*, which may be configured to adjust the shape of the window used by the windower 240*e* in dependence on the requirements. For exampled, the windowed shape adjuster 240*l* may, optionally, receive the decoded time warp information 232 and adjust the window in dependence on said decoded time warp information 232. Alternatively, or in addition, the window shape adjuster 240*l* may be configured to adjust the window shape used by the windower 240*e* in dependence on an information indicating whether a long block mode or a short block mode is used, if the warp decoder 240 is switchable between such a long block mode and a short block mode. Alternatively, or in addition, the window shape adjuster 240*l* may be configured to select an appropriate window shape for use by the windower 240*e* in dependence on a window sequence information if different window types are used by the warp decoder 240. However, it should be noted that the window shape adjustment, which is performed by the window shape adjuster 240*l*, should be considered as being optional and is not particularly relevant for the present invention.

Moreover, the warp decoder 240 may, optionally, comprise the sampling rate adjuster 240*m*, which may be configured to control the window shape adjuster 240*l* and/or the sampling position calculator 240*k* in dependence on the sampling frequency information 218. However, the sampling rate adjustment 240*m* may be considered as optional and is not of particular relevance for the present invention.

Regarding the functionality of the warp decoder 240, it can be said that the encoded representation 214 of the spectrum, which may, for example, comprise a set of transform coefficients (also designated as spectral coefficients) for each of a plurality of audio frames (or even a plurality of sets of spectral coefficients for some audio frames), is first decoded using the decoder 240*a*, such that the decoded spectrum representation 240*b* is obtained. The decoded spectrum representation 240*b* of a block or frame of the encoded audio signal is transformed into a time-domain representation (comprising, for example, a predetermined number of time-domain samples per audio frame) of said block or frame of the audio content. Typically, but not necessarily, the decoded representation 240*b* of the spectrum comprises pronounced peaks and valleys, because such a spectrum can be encoded efficiently. Consequently, the time-domain representation 240*d* comprises a comparatively small pitch variation during a single block or frame (which corresponds to a spectrum having pronounced peaks and valleys).

The windowing 260*e* is applied to the time-domain representation 240*d* of the audio signal to allow for an overlap-and-add operation. Subsequently, the windowed time-domain representation 240*f* is re-sampled in a time-varying manner, wherein the re-sampling is performed in accordance with the time warp information included, in an encoded form, in the encoded audio signal representation 210. Accordingly, the re-sampled audio signal representation 240*i* typically comprises a significantly larger pitch variation than the windowed time-domain representation 240*f*, provided the encoded time warp information describes a time warp, or, equivalently, a pitch variation. Thus, an audio signal comprising a significant pitch variation over a single audio frame can be provided at the output of the re-sampler 240*g*, even though the output signal 240*d* of the inverse transformer 240*c* comprises a significantly smaller pitch variation over a single audio frame.

However, the warp decoder 240 may be configured to handle encoded spectrum representations which are provided using different sampling frequencies, and to provide the decoded audio signal representation 212 with different sampling frequencies. However, a number of time-domain samples per audio frame or audio block may be identical for a plurality of different sampling frequencies. Alternatively, however, the warp decoder 240 may be switchable between a short block mode, in which an audio block comprises a comparatively small number of samples (for example, 256 samples) and a long block mode in which an audio block comprises a comparatively large number of samples (for example, 2048 samples). In this case, the number of samples per audio block in the short block mode is identical for the different sampling frequencies, and the number of audio samples per audio block (or audio frame) in the long block mode is identical for the different sampling frequencies. Also, the number of time warp codewords per audio frame is typically identical for the different sampling frequencies. Accordingly, a uniform bitstream format can be achieved, which is substantially independent (at least with respect to a number of time-domain samples encoded per audio frame, and with respect to a number of time warp codewords per audio frame) from the sampling frequency.

However, in order to have both a bitrate efficient encoding of the time warp information and a sufficient resolution of the time warp information, the encoding of the time warp information is adapted to the sampling frequency at the side of an audio signal encoder 300, which provides the encoded audio signal representation 210. Consequently, the decoding of the encoded time warp information 216, which comprises the mapping of time warp codewords onto decoded time warp values, is adapted to the sampling frequency. Details regarding this adaptation of the decoding of the time warp information will be described subsequently.

5. Adaptation of Time Warp Encoding and Decoding 5.1. Conceptual Overview

In the following, details regarding the adaptation of the time warp encoding and decoding in dependence on a sampling frequency of an audio signal to be encoded or an audio signal to be decoded will be described. In other words, a sampling frequency dependent pitch variation quantization will be described. In order to facilitate the understanding, some conventional concepts will first be described.

In conventional audio encoders and audio decoders using a time warp, the quantization table for the pitch variation or a warp is fixed for all sampling frequencies. As an example, reference is made to the Working Draft 6 of the Unified-Speech-and-Audio-Coding ("WD6 of USAC", ISO/IEC JTC1/SC29/WG11 N11213, 2010). Since the update distance in samples (for example, a distance, in terms of audio samples, of time instances for which a time warp value is transmitted from an audio encoder to an audio decoder) is also fixed (both in conventional time warp audio encoders/audio decoders and in time warp audio encoders/audio decoders according to the present invention), applying such a coding scheme at a lower bitrate leads to a smaller range of actual pitch changes (for example, in terms of pitch change per unit time) that can be covered. Typical maximum changes in the fundamental frequency of speech are below about 15 oct/s (15 octaves per second).

The table of FIG. 4*c* shows the finding that for certain sampling frequencies that are used in audio coding, the coding scheme described in reference [3] is not able to map the desired pitch variation range and therefore leads to a sub-optional coding gain. To show this effect, the table of FIG. 4*c* shows the warps for different sampling frequencies for the table (for example, mapping table for mapping time warp codewords onto decoded time warp values) used in the audio decoder described in reference [3]. The formula to obtain those warp values in oct/s is:

$$w = \log_2\left(\frac{\frac{f_s \cdot n_p}{n_f}}{p_{rel}}\right), \tag{1}$$

In the above equation w designates a warp, $p_{rel}$ designates a relative pitch change factor, $f_s$ designates a sampling frequency, $n_p$ designates a number of pitch nodes in one frame and $n_f$ designates a frame length in samples.

Accordingly, the table of FIG. 4*c* shows warps of the quantization scheme used in the audio decoder described in reference[3], wherein $n_f$=1024 and $n_p$=16.

In accordance with the present invention, it has been found that it is advantageous to adapt the mapping of the warp value index (which may be considered as a time warp codeword)

onto a corresponding time warp value $p_{rel}$ in dependence on the sampling frequency. In other words, it has been found that the solution to the above-mentioned problems is to design distinct quantization tables for different sampling frequencies in such a way that the absolute range of covered pitch variations or warps in oct/s (octaves per second) is the same (or at least approximately the same) for all sampling frequencies. It has been found that this might be done, for example, by providing several explicit quantization tables, each used for a narrow range of neighbored sampling frequencies, or by a calculation of the quantization table on the fly for the used sampling frequencies.

In accordance with an embodiment of the invention, this might be done by providing a table of warp values and calculating the quantization table for the relative pitch change factor by transforming the formula from above:

$$p_{rel} = 2^{\frac{n_f \cdot w}{f_s \cdot n_p}} \tag{2}$$

In the above equation $p_{rel}$ designate a relative pitch change factor, $n_f$ designate the frame length in samples, w designates the warp, $f_s$ designates the sampling frequency and $n_p$ designates the number of pitch nodes in one frame. Using said equation, the relative pitch change factors $p_{rel}$, which are shown in the table of FIG. 4*d*, can be obtained.

Taking reference to FIG. 4*d*, a first column 480 designated an index, which index may be considered as a time warp codeword, and which index may be included in the bitstream representing the encoded audio signal representation 210. A second column 482 describes a maximum representable time warp (in terms of oct/s), which can be represented by $n_p$ relative pitch change factors $p_{rel}$ associated with the index shown in the first column and in the respective row. A third column 484 describes a relative pitch change factor associated with the index given in the first column 480 of the respective row for a sampling frequency of 24000 Hz. A fourth column 486 shows relative pitch change factors associated with index values shown in the first column 480 of the respective row for a sampling frequency of 12000 Hz. As can be seen, indices 0, 1 and 2 correspond to relative pitch change factors $p_{rel}$ for a "negative" change of the pitch (i.e., for a reduction of the pitch), index value 3 corresponds to a relative pitch change factor of 1, which represents a constant pitch, and indices 4, 5, 6 and 7 are associated with relative pitch change factors $p_{rel}$ describing a "positive" time warp, i.e. an increase of the pitch.

However, it has been found that there are different concepts for obtaining the relative pitch change factors. It has been found that one other way to obtain the relative pitch change factors is to design a table of quantization values for the relative pitch change factor and a corresponding reference sampling rate. The actual quantization table for a given sampling frequency can then simply be derived from the designed table using the following formula:

$$p_{rel} = 1 + (p_{rel,ref} - 1)\frac{f_{s,ref}}{f_s} \tag{3}$$

$p_{rel}$ describes a relative pitch change factor for a current sampling frequency $f_s$. In addition, $p_{rel,ref}$ describes a relative pitch change factor for the reference sampling frequency $f_{s,ref}$. A set of reference pitch change factors $p_{rel,ref}$ associated with different indices (time warp codewords) may be stored in a table, wherein the reference sampling frequency $f_{s,ref}$, to which the reference (relative) pitch change factors correspond, is known.

It has been found that the latter formula gives a reasonable approximation to the results obtained by the formula above while being computationally less complex.

FIG. 4*e* shows a table representation of relative pitch change factors $p_{rel}$, which are obtained from reference relative pitch change factors $p_{rel,ref}$, wherein the table holds for a reference sampling frequency $f_{s,ref}$=24000 Hz.

A first column 490 describes an index, which may be considered as a time warp codeword.

A second column 492 describes reference relative pitch change factors $p_{rel,ref}$ associated with the indices (or codewords) shown in the first column 490 in the respective row. A third column 494 and a fourth column 496 describe (relative) pitch change factors associated with the indices of the first column 490 for a sample frequency $f_s$ of 24000 Hz (third column 494) and 12000 Hz (fourth column 496). As can be seen, the relative pitch change factors $p_{rel}$ for a sampling frequency $f_s$ of 24000 Hz, which are shown in the third column 494 are identical to the reference relative pitch change factors shown in the second column 492, because the sampling frequency $f_s$ of 24000 Hz is equal to the reference sampling frequency $f_{s,ref}$. However, the fourth column 496 shows relative pitch change factors $p_{rel}$ at a sampling frequency $f_s$ of 12000 Hz, which are derived from the reference relative pitch change factors of the second column 492 in accordance with the above equation (3).

Of course, such normalization procedures, as described above, can easily be applied straightforward to any other representation of a change in frequency or pitch, for example, also to a scheme coding the absolute pitch or frequency values and not the relative changes thereof.

5.2. Implementation According to FIG. 4*a*

Figure 4A:
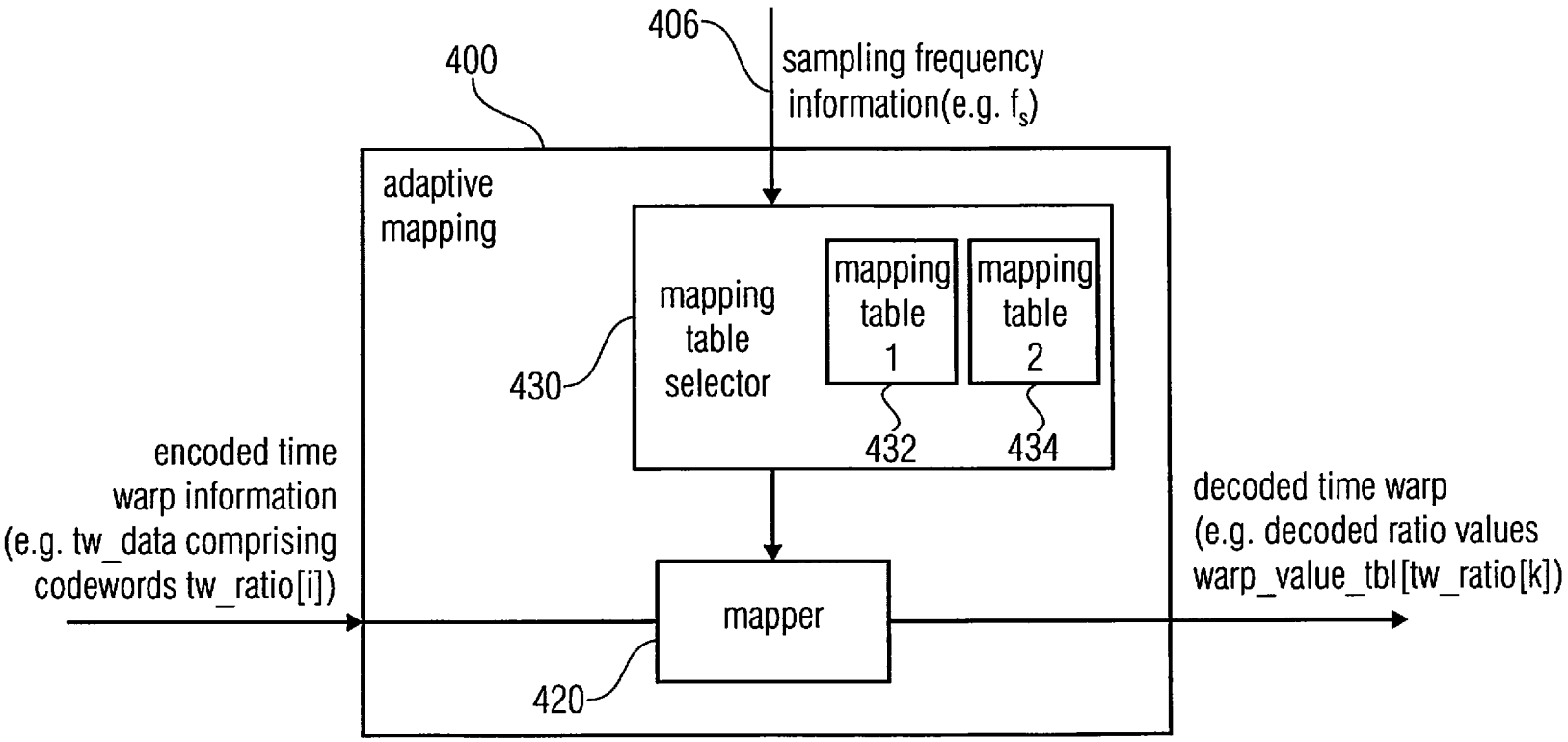
FIG. 4*a* shows a block schematic diagram of a mapper for mapping an encoded time warp information onto decoded time warp values, according to an embodiment of the invention.

FIG. 4*a* shows a block schematic diagram of an adaptive mapping 400, which may be used in embodiments according the invention.

For example, the adaptive mapping 400 may take place of the mapping 234 in the audio signal decoder 200 or of the mapping 234 in the audio signal decoder 350.

The adaptive mapping 400 is configured to receive an encoded time warp information, like, for example, a so-called "tw_data" information comprising time warp codewords "tw_ratio[i]". Accordingly, the adaptive mapping 400 may provide decoded time warp values, for example, decoded ratio values, which are sometimes designated as values "warp_value_tbl[tw_ratio]", and which are sometimes also designated as relative pitch change factors $p_{rel}$. The adaptive mapping 400 also receives a sampling frequency information which describes, for example, the sampling frequency $f_s$ of the time-domain representation 240*d* provided by the inverse transform 230*c*, or the average sampling frequency of the windowed and re-sampled time domain representation 240*i* provided by the re-sampling 240*g*, or the sampling frequency of the decoded audio signal representation 212.

The adaptive mapping comprises a mapper 420, which provides a decoded time warp value as a function of a time warp codeword of the encoded time warp information. A mapping rule selector 430 selects a mapping table, out of a plurality of mapping tables 432, 434 for the use by the mapper 420 in dependence on the sampling frequency information 406. For example, the mapping table selector 430 selects a mapping table, which represents a mapping defined by the first column 480 of the table of FIG. 4*d* and the third column 484 of the table of FIG. 4*d* if the current sampling frequency is equal to 24000 Hz, or if the current sampling frequency is in a predetermined environment of 24000 Hz. In contrast, the mapping table selector 430 may select a mapping table, which represents a mapping defined by the first column 480 of the table of FIG. 4*d* and the fourth column 486 of the table of FIG. 4*d*, if the sampling frequency $f_s$ is equal to 12000 Hz or if the sampling frequency $f_s$ is in a predetermined environment of 12000 Hz.

Accordingly, time warp codewords (also designated as "indices") 0-7 are mapped to the respective decoded time warp values (or relative pitch change factors) shown in the third column 484 of the table of FIG. 4*d* if the sampling frequency is equal to 24000 Hz, and onto respective decoded time warp values (or relative pitch change factors) shown in the fourth column 486 of the table of FIG. 4*d*. If a sampling frequency is equal to 12000 Hz.

To summarize, different mapping tables may be selected by the mapping table selector 430 in dependence on the sampling frequency, to thereby map a time warp codeword (for example, a value "index" included in a bitstream representing the decoded audio signal) onto a decoded time warp value (for example, a relative pitch change factor $p_{rel}$, or a time warp value "warp_value_tbl").

5.3. Implementation According to FIG. 4*b*

Figure 4B:
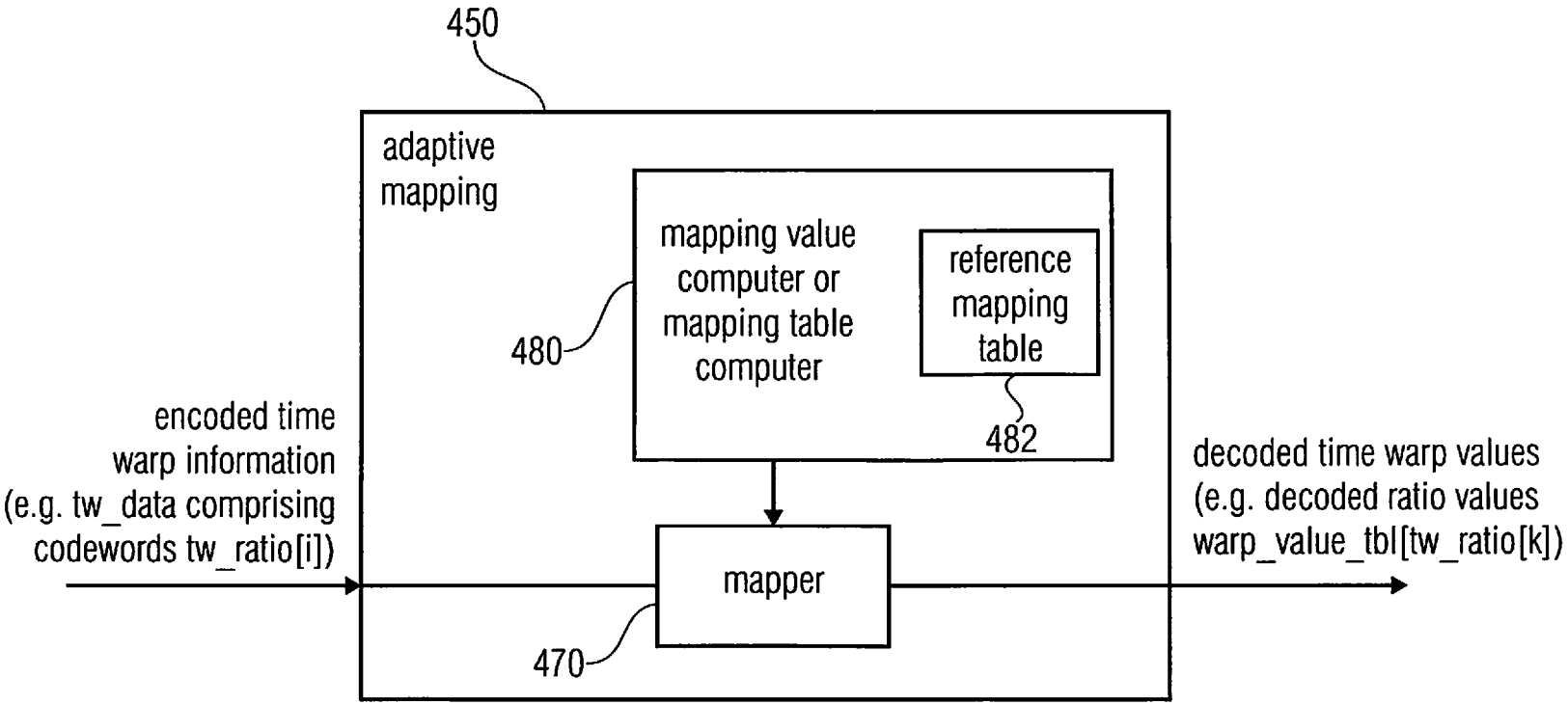
FIG. 4*b* shows a block schematic diagram of a mapper for mapping an encoded time warp information onto decoded time warp values, according to another embodiment of the invention.

FIG. 4*b* shows a block schematic diagram of an adaptive mapping 450, which may be used in embodiments according to the invention. For example, the adaptive mapping 450 may take place of the mapping 234 in the audio signal decoder 200 or of the mapping 234 in the audio signal decoder 350. The adaptive mapping 450 is configured to receive an encoded time warp information, wherein the above explanations regarding the adaptive mapping 400 hold.

First of all, the adaptive mapping 450 is configured to provide decoded time warp values, wherein the above explanations with respect to the adaptive mapping 400 also hold.

The adaptive mapping 450 comprises a mapper 470, which is configured to receive a codeword of the encoded time warp and to provide a decoded time warp value. The adaptive mapping 450 also comprises a mapping value computer or a mapping table computer 480.

In the case of a mapping value computer, the decoded time warp value is computed according to the above equation (3). For this purpose, the mapping value computer may comprise a reference mapping table 482. The reference mapping table 482 may, for example, describe the mapping information which is defined by a first column 490 and a second column 492 of the table of FIG. 4*e*. Accordingly, the mapping value computer 480 and the mapper 470 may cooperate such that a corresponding reference relative pitch change factor is selected for a given time warp codeword on the basis of the reference mapping table, and such that the relative pitch change factor $p_{rel}$ corresponding to said given time warp codeword is computed in accordance with equation (3) using the information about the current sampling frequency $f_s$ and returned as decoded time warp value. In this case, it is not even necessitated to store all the entries of a mapping table adapted to the current sampling frequency $f_s$ at the price of a computation of the decoded time warp value (relative pitch change factor) for each time warp codeword.

Alternatively, however, the mapping table computer 480 may pre-compute a mapping table adapted to the current sampling frequency $f_s$ for usage by the mapper 470. For example, the mapping table computer may be configured to compute the entries of the fourth column 496 of FIG. 4*e* in response to the finding that a current sampling frequency of 12000 Hz is selected. The computation of said relative pitch change factors $p_{rel}$ for a sampling frequency $f_s$ of 12000 Hz may be based on the reference mapping table (comprising, for example, the mapping defined by the first column 490 and the second column 492 of the table of FIG. 4*e*), and may be performed using equation (3).

Accordingly, said pre-computed mapping table may be used for the mapping of a time warp codeword onto a decoded time warp value. Moreover, the pre-computed mapping table may be updated whenever the re-sampling rate is changed.

To summarize, the mapping rule for the mapping of time warp codewords onto decoded time warp values may be evaluated or computed on the basis of the reference mapping table 482, wherein a pre-computation of a mapping table adapted to the current sampling frequency or an on-de-fly computation of the decoded time warp value may be performed.

6. Detailed Description of the Computation of the Time Warp Control Information

In the following, details regarding the computation of the time warp control information on the basis of a time warp contour evolution information will be described.

6.1. Apparatus according to FIGS. 5*a* and 5*b*

Figure 5A:
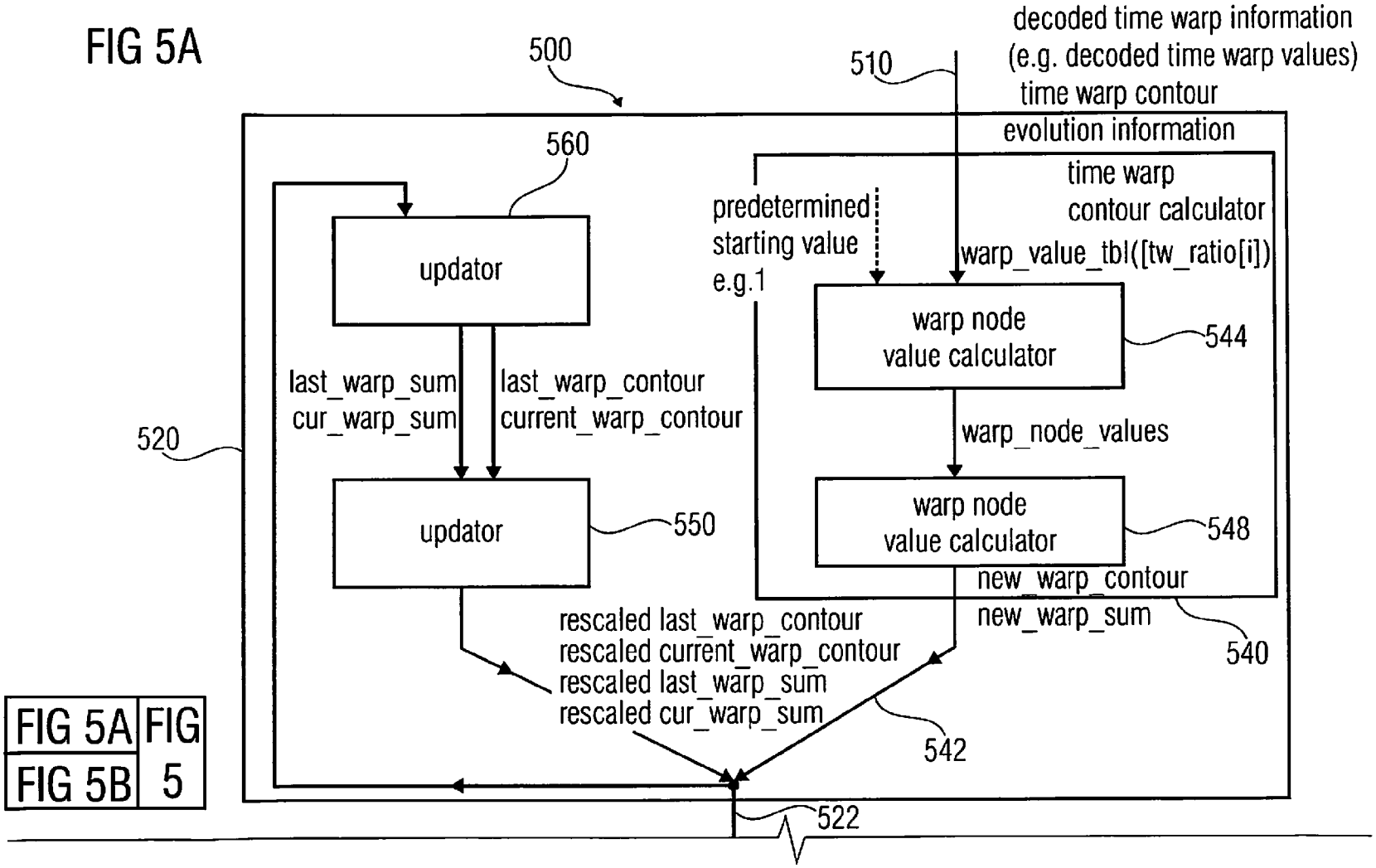
FIGS. 5*a*, 5*b* show a detailed extract from a block schematic diagram of an audio signal decoder, according to an embodiment of the invention.
Figure 5B:
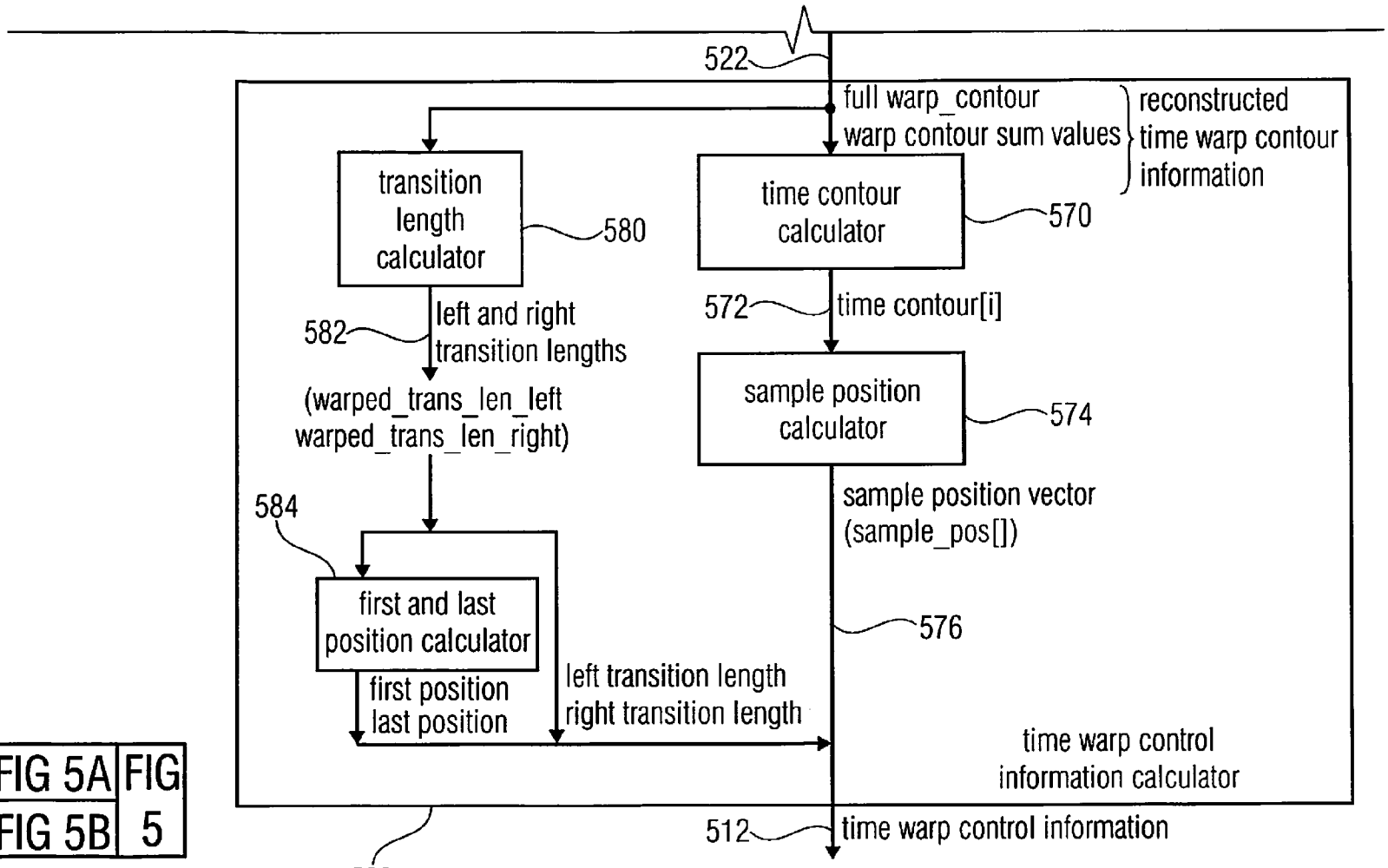

FIGS. 5*a* and 5*b* show a block schematic diagram of an apparatus 500 for providing a time warp control information 512 on the basis of a time warp contour evolution information 510, which may be a decoded time warp information, and which may, for example, comprise decoded time warp values provided by the mapping 234 of the time warp calculator 230. The apparatus 500 comprises the means 520 for providing the reconstructed time warp contour information 522 on the basis of the time warp contour evolution information 510 and a time warp control information calculator 530 to provide the time warp control information 512 on the basis of the reconstructed time warp contour information 522.

In the following, the structure and functionality of the means 520 will be described.

The means 520 comprises a time warp contour calculator 540, which is configured to receive the time warp contour evolution information 510 and to provide, on the basis thereof, a new time warp contour portion information 542. For example, a set of time warp contour evolution information (for example, a set of a predetermined number of decoded time warp values provided by the mapping 234) may be transmitted to the apparatus 500 for each frame of the audio signal to be reconstructed. Nevertheless, the set of time warp contour evolution information 510 associated with a frame of the audio signal to be reconstructed may be used for the reconstruction of a plurality of frames of the audio signal in some cases. Similarly, a plurality of sets of time warp contour evolution information may be used for the reconstruction of the audio content of a single frame of the audio signal, as will be discussed in detail in the following. As a conclusion, it can be stated that, in some embodiments, the time warp contour evolution information may be updated at the same rate at which sets of the transform-domain coefficients of the audio signal to be reconstructed are updated (1 set of time warp contour evolution information 510 per frame of the audio signal, and/or one time warp contour portion per frame of the audio signal).

The time warp contour calculator 540 comprises a warp node value calculator 544, which is configured to compute a plurality (or temporal sequence) of warp contour node values on the basis of a plurality (or temporal sequence) of time warp contour ratio values, wherein the time warp ratio values are comprised by the time warp contour evolution information 510. In other words, the decoded time warp values provided by the mapping 234 may constitute the time warp ratio values (e.g., warp_value_tbl[tw_ratio[]]). For this purpose, the warp node value calculator 544 is configured to start the provision of the time warp contour node values at a predetermined starting value (for example, 1) and to calculate subsequent time warp contour node values using the time warp contour ratio values, as will be discussed below.

Further, the time warp contour calculator 544 optionally comprises an interpolator 548, which is configured to interpolate between subsequent time warp contour node values.

Accordingly, the description 542 of the new time warp contour portion is obtained, wherein the new time warp contour portion typically starts from the predetermined starting value used by the warp node calculator 524. Furthermore, the means 520 is configured to store the so-called "last time warp contour portion" and the so-called "current time warp contour portion" in a memory not shown in FIG. 5.

However, the means 520 also comprises a rescaler 550, which is configured to rescale the "last time warp contour portion" and the "current time warp contour portion" to avoid (or reduce, or eliminate) any discontinuities in the full time warp contour section, which is based on the "last time warp contour portion", the "current time warp contour portion" and the "new time warp contour portion". For this purpose, the rescaler 550 is configured to receive the stored description of the "last time warp contour portion" and of the "current time warp contour portion" and to jointly rescale the "last time warp contour portion" and the "current time warp contour portion" to obtain rescaled versions of the "last time warp contour portion" and the "current time warp contour portion". Some details regarding this functionality will be described below.

Moreover, the rescaler 550 may also be configured to receive, for example, from a memory not shown in FIG. 5, a sum value associated with the "last time warp contour portion" in another sum value associated with the "current time warp portion". These sum values are sometimes designated with "last_warp_sum" and "cur_warp_sum", respectively. The rescaler 550 is configured to rescale the sum values associated with the time warp contour portions using the same rescale factor which the corresponding time warp contour portions are rescaled with. Accordingly, rescaled sum values are obtained.

In some cases, the means 520 may comprise an updater 560, which is configured to repeatedly update the time warp contour portions input into the rescaler 550 and also the sum values input into the rescaler 550. For example, the updater 560 may be configured to update said information at the frame rate. For example, the "new time warp contour portion" of the present frame cycle may serve as the "current time warp contour portion" in a next frame cycle. Similarly, the rescaled "current time warp contour portion" of the current frame cycle may serve as the "last time warp contour portion" in a next frame cycle. Accordingly, a memory efficient implementation is created, because the "last time warp contour portion" of the current frame cycle may be discarded upon completion of the "current frame cycle".

To summarize the above, the means 520 is configured to provide, for each frame cycle (with the exception of some special frame cycles, for example, at the beginning of a frame sequence, or at the end of a frame sequence, or in a frame in which time warping is inactive) a description of a time warp contour section comprising a description of a "new time warp contour portion", of a "rescaled current time warp contour portion" and of a "rescaled last time warp contour portion". Furthermore, the means 520 may provide, for each frame cycle (with the exception of the above-mentioned special frame cycles) a representation of a warp contour sum values, for example, comprising a "new time warp contour portion sum value", a "rescaled current time warp contour sum value" and a "rescaled last time warp contour sum value".

The time warp control information calculator 530 is configured to calculate the time warp control information 512 on the basis of the reconstructed time warp contour information 542 provided by the means 520. For example, the time warp control information calculator 530 comprises a time contour calculator 570, which is configured to compute a time contour 572 (e.g., a sample-wise representation of the time warp contour) on the basis of the reconstructed time warp contour information. Furthermore, the time warp contour information calculator 530 comprises a sample position calculator 574, which is provided to receive the time contour 572 and to provide, on the basis thereof, a sample position information, for example, in the form of a sample position vector 576. The sample position vector 576 describes the time warping performed, for example, by the re-sampler 240*g*.

The time warp control information calculator 530 also comprises a transition length calculator, which is configured to derive a transition length information from the reconstructed time warp control information. The transition length information 582 may, for example, comprise an information describing a left transition length and an information describing a right transition length. The transition length may, for example, depend on the length of time segments described by the "last time warp contour portion", the "current time warp contour portion" and the "new time warp contour portion". For example, the transition length may be shortened (when compared to a default transition length) if the temporal extension of a time segment described by the "last time warp contour portion" is shorter than a temporal extension of the time segment described by the "current time warp portion", or if the temporal extension of a time segment described by the "new time warp contour portion" is shorter than the temporal extension of the time segment described by the "current time warp contour portion".

In addition, the time warp control information calculator 530 may further comprise a first and last position calculator 584, which is configured to calculate the so-called "first position" and a so-called "last position" on the basis of the left and right transition length. The "first position" and the "last position" increase the efficiency of the re-sampler, if regions outside of these positions are identical to zero after windowing and are therefore not needed to be taken into account for the time warping. It should be noted here that the sample position vector 576 comprises, for example, information used (or even necessitated) by the time warping performed by the re-sampler 240*g*. Furthermore, the left and right transition length 582 and the "first position" and the "last position" 586 constitute information which is, for example, used (or even necessitated) by the windower 240*e*.

Accordingly, it can be said that the means 520 and the time warp control information calculator 530 may together take over the functionality of the sample rate adjustment 240*m*, of the window shape adjustment 240*l* and of the sampling position calculation 240*k*.

6.2. Functional Description According to FIGS. 6*a* and 6*b*

In the following, the functionality of an audio decoder comprising the means 520 and the time warp control information calculator 530 will be described with reference to FIGS. 6*a* and 6*b*.

Figure 6A:
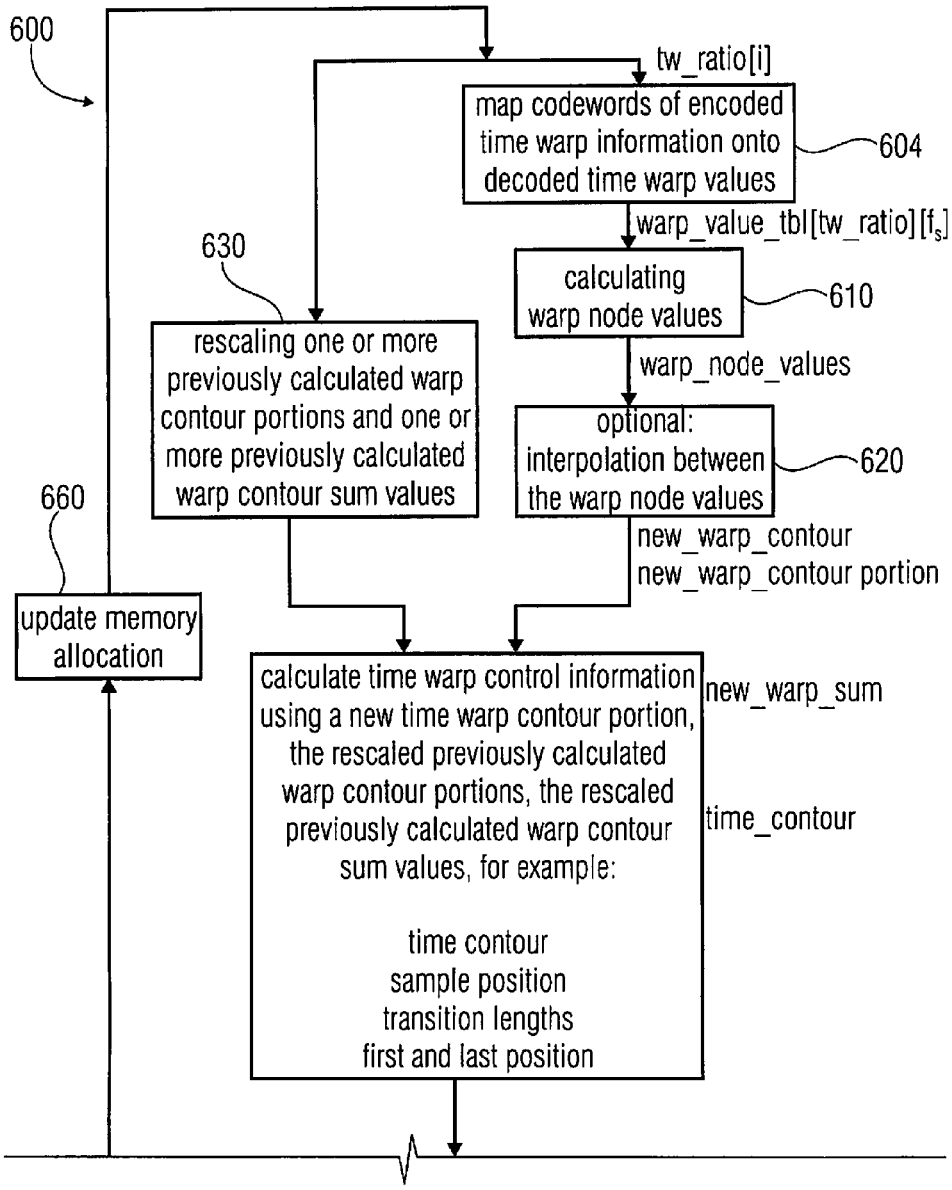
FIGS. 6*a*, 6*b* show a detailed extract of a flowchart of a mapper for providing a decoded audio signal representation, according to an embodiment of the invention.
Figure 6B:
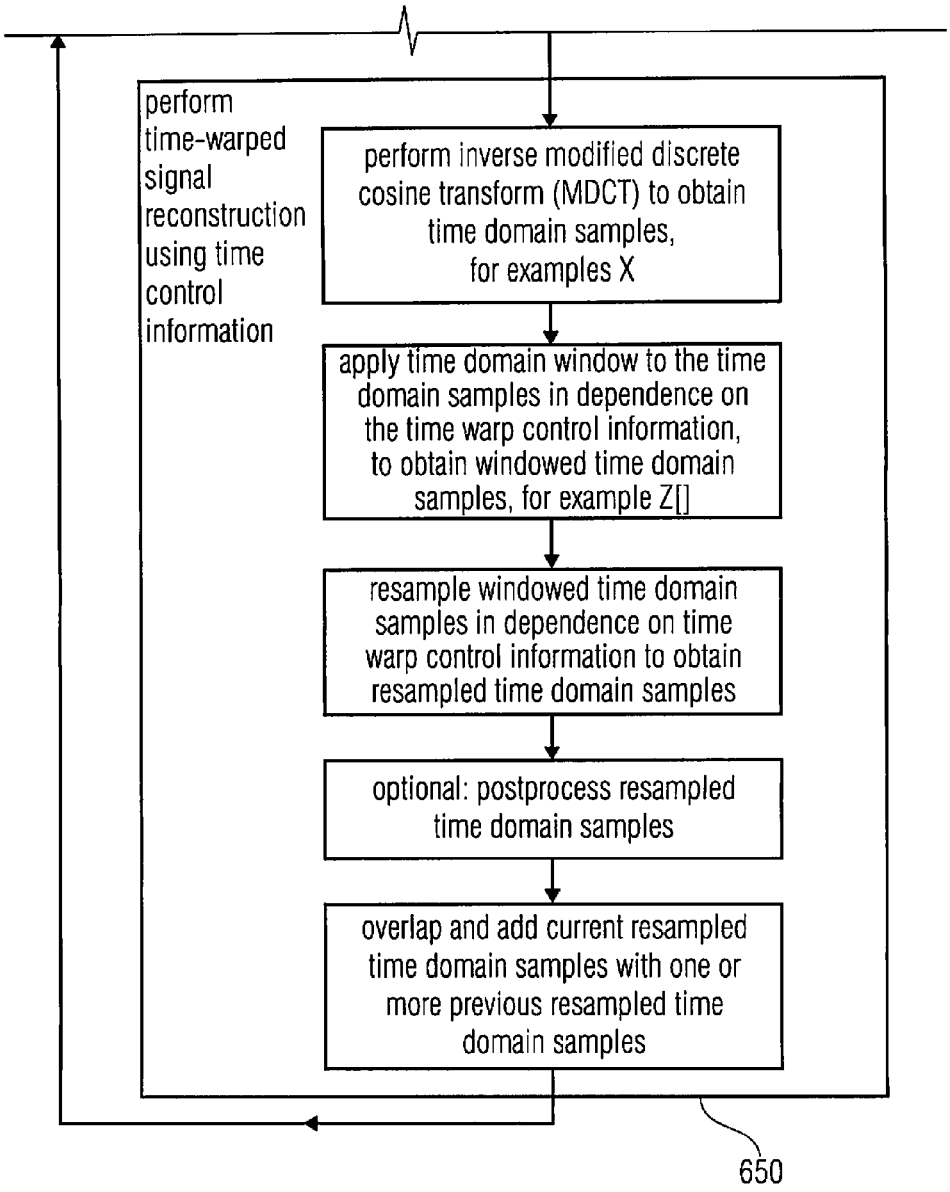

FIGS. 6*a* and 6*b* show a flowchart of a method for decoding an encoded representation of an audio signal, according to an embodiment of the invention. The method 600 comprises providing a reconstructed time warp contour information, wherein providing the reconstructed time warp contour information comprises mapping 604 codewords of an encoded time warp information onto decoded time warp values, calculating 610 warp node values, interpolating 620 between the warp node values and rescaling 630 one or more previously calculated warp contour portions and one or more previously calculated warp contour sum values. The method 600 further comprises calculating 640 time warp control information using a "new time warp contour portion" obtained in steps 610 and 620, the rescaled previously calculated time warp contour portions ("current time warp contour portion", "last time warp contour portion") and also, optionally, using the resealed previously calculated warp contour sum values. As a result, a time contour information, and/or a sample position information, and/or a transition length information and/or a first position and a last position information can be obtained in the step 640.

The method 600 further comprises performing 650 time warp signal reconstruction using the time warp control information obtained in step 640. Details regarding the time warp signal reconstruction will be described subsequently.

The method 600 also comprises a step 660 of updating a memory, as will be described below.

7. Detailed Description of the Algorithm 7.1. Overview

In the following, some of the algorithms performed by an audio decoder according to an embodiment of the invention will be described in detail. For this purpose, reference is made to FIGS. 5*a*, 5*b*, 6*a*, 6*b*, 7*a*, 7*b*, 8, 9, 10*a*, 10*b*, 11, 12, 13, 14, 15 and 16.

First of all, reference is made to FIG. 7*a*, which shows a legend of definitions of data elements and a legend of definitions of help elements. Moreover, reference is made to FIG. 7*b*, which shows a legend of definitions of constants.

Generally speaking, it can be said that the methods described here can be used for the decoding of an audio stream which is encoded according to a time-warped modified discrete cosine transform. Thus, when the TW-MDCT is enabled for an audio stream (which may be indicated by a flag, for example, referred to as "twMDCT" flag, which may be comprised in a specific configuration information), a time-warped filter bank and block switching may replace a standard filter bank and block switching in an audio decoder. Additionally to the inverse modified discrete cosine transform (IMDCT) the time-warped filter bank and block switching contains a time-domain-to-time-domain mapping from an arbitrarily spaced time grid to a normal regularly spaced or linearly spaced time grid and a corresponding adaptation of window shapes.

It should be noted here, that the decoding algorithm described here may be performed, for example, by the warp decoder 240 on the basis of the encoded representation 214 of the spectrum and also on the basis of the encoded time warp information 232.

7.2. Definitions:

With respect to the definition of data elements, help elements and constants, reference is made to FIGS. 7*a* and 7*b*.

7.3. Decoding Process-Warp Contour

The codebook indices of the warp contour nodes are decoded as follows to warp values for the individual nodes:

$$\text{warp_node_values}[i] = \begin{cases} 1 & \text{for tw_data_present} = 0,\ 0 \le i \le \text{NUM_TW_NODES} \\ 1 & \text{for tw_data_present} = 1,\ i = 0 \\ \prod_{k=0}^{i-1} \text{warp_value_tbl}[\text{tw_ratio}[k]] & \text{for tw_data_present} = 1,\ 0 < i \le \text{NUM_TW_NODES} \end{cases}$$

However, the mapping of the time warp codewords "tw_ratio[k]" onto decoded time warp values, designated here as "warp_value_tbl[tw_ratio[k]]", is dependent on the sampling frequency in the embodiments according to the invention. Accordingly, there is not a single mapping table in the embodiments according to the invention, but there are individual mapping tables for different sampling frequencies.

For example, the result values "warp_value_tbl[tw_ratio[k]]", which are returned by a mapping table access to a mapping table corresponding to the current sampling frequency, may be considered as decoded time warp values, and may be provided by the mapping 234, by the adaptive mapping 400 or by the adaptive mapping 450 on the basis of time warp codewords "tw_ratio[k]" included in a bitstream that constitutes (or represents) the encoded audio signal representation 210.

To obtain the sample-wise (n_long samples) new warp contour data "new_warp_contour[ ]", the warp node values "warp_node_values[ ]" are now interpolated linearly between the equally spaced (interp_dist apart) nodes using an algorithm, a pseudo program code representation which is shown in FIG. 9.

Before obtaining the full warp contour for this frame (for example, for a current frame), the buffered values from the past may be rescaled, so that the last warp value of the past warp contour "past_warp_contour[ ]"=1.

$$\text{norm_fac} = \frac{1}{\text{past_warp_contour}[2 \cdot \text{n_long} - 1]}$$

$$\text{past_warp_contour}[i] = \text{past_warp_contour}[i] \cdot \text{norm_fac} \text{ for } 0 \le i < 2 \cdot \text{n_long}$$

$$\text{last_warp_sum} = \text{last_warp_sum} \cdot \text{norm_fac}$$

$$\text{cur_warp_sum} = \text{cur_warp_sum} \cdot \text{norm_fac}$$

The full warp contour "warp_contour[ ]" is obtained by concatenating the past warp contour "past_warp_contour" and the new warp contour "new_warp_contour", and the new warp sum "new_warp_sum" is calculated as a sum over all new warp contour values "new_warp_contour[ ]":

$$\text{new_warp_sum} = \sum_{i=0}^{n_long-1} \text{new_warp_contour}[i]$$

7.4. Decoding Process-Sample Position and Window Length Adjustment

From the warp contour "warp_contour[ ]", a vector of the sample positions of the warped samples on a linear time scale is computed. For this, the time warp contour is generated in accordance with the following equations:

$$\text{time_contour}[i] = \begin{cases} -w_{res} \cdot \text{last_warp_sum} & \text{for } i = 0 \\ w_{res}\left(-\text{last_warp_sum} + \sum_{k=0}^{i-1} \text{warp_contour}[k]\right) & \text{for } 0 < i \le 3 \cdot \text{n_long} \end{cases}$$

$$\text{where } w_{res} = \frac{\text{n_long}}{\text{cur_warp_sum}}.$$

With the helper functions "warp_inv_vec( )" and "warp_time_inv( )", pseudo program code representations of which are shown in FIGS. 10*a* and 10*b*, respectively, the sample position vector and the transition length are computed in accordance with an algorithm, a pseudo program code representation of which is shown in FIG. 11.

7.5. Decoding Process-Inverse Modified Discrete Cosine Transform (IMDCT)

In the following, the inverse modified discrete cosine transform will be briefly described.

The analytical expression of the inverse modified discrete cosine transform is as follows:

$$x_{i,n} = \frac{2}{N}\sum_{k=0}^{\frac{N}{2}-1} spec[i][k]\cos\left(\frac{2\pi}{N}(n+n_0)\left(k+\frac{1}{2}\right)\right) \text{ for } 0 \le n < N$$

where:

n=sample index i=window index k=spectral coefficient index

N=window length based on the window_sequence value $n_0$=(N/2+1)/2

The synthesis window length for the inverse transform is a function of the syntax element "window_sequence" (which may be included in the bitstream) and the algorithmic context. The synthesis window length may, for example, be defined in accordance with the table of FIG. 12.

The meaningful block transitions are listed in the table of FIG. 13. A tick mark in a given table cell indicates that a window sequence listed in this particular row may be followed by a window sequence listed in this particular column.

Regarding the allowed window sequences, it should be noted that the audio decoder may, for example, be switchable between windows of different lengths. However, the switching of window lengths is not of particular relevance for the present invention. Rather, the present invention can be understood on the basis of the assumption that there is a sequence of windows of type "only_long_sequence" and that the core coder frame length is equal to 1024.

Moreover, it should be noted that the audio signal decoder may be switchable between a frequency-domain coding mode and a time-domain coding mode. However, this possibility is not of particular relevance to the present invention. Rather, the present invention is applicable in audio signal decoders which are only capable of handling the frequency domain coding mode, as discussed, for example, with reference to FIGS. 1, 2, 3*a* and 3*b*.

7.6. Decoding Process-Windowing and Block switching

In the following, the windowing and block switching, which may be performed by the warp decoder 240 and, in particular, by the windower 240*e* thereof, will be described.

Depending on the "window_shape" element (which may be included in a bitstream representing the audio signal) different oversampled transform window prototypes are used, and the length of the oversampled windows is $$N_{OS}=2\cdot n_long\cdot OS_FACTOR_WIN$$

For window_shape=1, the window coefficients are given by the Kaiser-Bessel derived (KBD) window as follows:

$$W_{KBD}\left(n-\frac{N_{OS}}{2}\right) = \sqrt{\frac{\sum_{p=0}^{N_{OS}-n-1}[W(p,\alpha)]}{\sum_{p=0}^{N_{OS}/2}[W(p,\alpha)]}} \text{ for } \frac{N_{OS}}{2} \le n < N_{OS}$$

where:

W', Kaiser-Besser kernel function is defined as follows:

$$W'(n,\alpha) = \frac{I_0\left[\pi\alpha\sqrt{1.0-\left(\frac{n-N_{OS}/4}{N_{os}/4}\right)}\right]}{I_0[\pi\alpha]} \text{ for } 0 \le n \le \frac{N_{OS}}{2}$$

-continued $$I_0[x] = \sum_{k=0}^{\infty}\left[\frac{\left(\frac{x}{2}\right)^k}{k!}\right]^2$$

$a$ = kernel window alpha factor, $\alpha = 4$

Otherwise, for window_shape=0, a sine window is employed as follows:

$$W_{SIN}\left(n-\frac{N_{OS}}{2}\right) = \sin\left(\frac{\pi}{N_{OS}}\left(n+\frac{1}{2}\right)\right) \text{ for } \frac{N_{OS}}{2} \le n < N_{OS}$$

For all kinds of window sequences, the used protoype for the left window part is the determined by the window shape of the previous block. The following formula expresses this fact:

$$\text{left_window_shape}[n] = \begin{cases} W_{KBD}[n], & \text{if window_shape_previous_block} == 1 \\ W_{SIN}[n], & \text{if window_shape_previous_block} == 0 \end{cases}$$

Likewise the prototype for the right window shape is determined by the following formula:

$$\text{right_window_shape}[n] = \begin{cases} W_{KBD}[n], & \text{if window_shape} == 1 \\ W_{SIN}[n], & \text{if window_shape} == 0 \end{cases}$$

Since the transition lengths are already determined, it only should be differentiated between window sequence of type "EIGHT_SHORT_SEQUENCE" and all other window sequences.

In case the current frame is of type "EIGHT_SHORT_SEQUENCE", a windowing and internal (frame-internal) overlap-and-add is performed. The C-code-like portion of FIG. 14 describes the windowing and the internal overlap-add of the frame having window type "EIGHT_SHORT$_{13}$ SEQUENCE".

For frames of any other types, an algorithm may be used, a pseudo program code representation of which is shown in FIG. 15.

7.7. Decoding Process-Time-Varying Re-sampling

In the following, the time-varying re-sampling will be described, which may be performed by the warp decoder 240 and, in particular, by the re-sampler 240*g*.

The windowed block z[ ] is re-sampled according to the sample positions (which are provided by the sampling position calculator 240*k* on the basis of the decoded time warp values provided by the mapping 234) using the following impulse response:

$$b[n] = I_0[\alpha]^{-1}\cdot I_0\left[\alpha\sqrt{1-\frac{n^2}{\text{IP_LEN_}2^2}}\right]\cdot\frac{\sin\left(\frac{\pi n}{\text{OS_FACTOR_RESAMP}}\right)}{\frac{\pi n}{\text{OS_FACTOR_RESAMP}}}$$

for $0 \le n < \text{IP_SIZE}-1$ $\alpha = 8$

Before re-sampling, the windowed block is padded with zeros on both ends:

$$zp[n] = \begin{cases} 0, & \text{for } 0 \le n < \text{IP_LEN_2S} \\ z[n - \text{IP_LEN_2S}], & \text{for IP_LEN_2S} \le n < \text{N_f} + \text{IP_LEN_2S} \\ 0, & \text{for } 2 \cdot \text{N_f} + \text{IP_LEN_2S} \le n < \text{N_f} + 2 \cdot \text{IP_LEN_2S} \end{cases}$$

The re-sampling itself is described in a pseudo program code section shown in FIG. 16.

7.8. Decoding Process-Overlapping-and-Adding with Previous Window Sequences

The overlapping-and-adding, which is performed by the overlapper/adder 240*j* of the warp decoder 240, is the same for all sequences and can be described mathematically as follows:

$$out_{i,n} = \begin{cases} y'_{i,n} + y'_{i-1,n+n_long} + y'_{i-2,n+2\cdot n_long} & \text{for } 0 \le n < \text{n_long}/2 \\ y'_{i,n} + y'_{i-1,n+n_long} & \text{for n_long}/2 \le n < \text{n_long} \end{cases}$$

7.9. Decoding Process-Memory Update

In the following, a memory update will be described. Even though no specific means are shown in FIG. 3*d*, it should be noted that the memory update may be performed by the warp decoder 240.

The memory buffers needed for decoding the next frame are updated as follows:

past_warp_contour[n]=warp_contour[n+n_long], for 0≤n<2·n_long cur_warp_sum=new_warp_sum last_warp_sum=cur_warp_sum Before decoding the first frame or if the last frame was encoded with an optical LPC domain coder, the memory states are set as follows:

past _warp_contour[n]=1, for 0≤n<2·n_long cur_warp_sum=n_ long last_warp_sum=n_long 7.10. Decoding Process-Conclusion To summarize the above, a decoding process has been described, which may be performed by the warp decoder 240. As can be seen, a time-domain representation is provided for an audio frame of, for example, 2048 time-domain samples, and subsequent audio frames may, for example, overlap by approximately 50%, such that a smooth transition between time-domain representations of subsequent audio frames is ensured.

A set of, for example, NUM_TW_NODES=16 decoded time warp values may be associated with each of the audio frames (provided that the time warp is active in said audio frame), irrespective of the actual sampling frequency of the time-domain samples of the audio frame.

8. Audio Stream According to FIGS. 17*a*-17*f*

In the following, an audio stream will be described which comprises an encoded representation of one or more audio signal channels and one or more time warp contours. The audio stream described in the following may, for example, carry the encoded audio signal representation 112 or the encoded audio signal representation 210.

FIG. 17*a* shows a graphical representation of a so-called "USAC_raw_data_block" data stream element, which may comprise a signal channel element (SCE), a channel pair element (CPE) or a combination of one or more single channel elements and/or one or more channel pair elements.

The "USAC_raw_data_block" may typically comprise a block of encoded audio data, while additional time warp contour information may be provided in a separate data stream element. Nevertheless, it is naturally possible to encode some time warp contour data into the "USAC_raw_data_block".

As can be seen from FIG. 17*b*, a single channel element typically comprises a frequency domain channel stream ("fd_channel_stream"), which will be explained in detail with reference to FIG. 17*d*.

As can be seen from FIG. 17*c*, a channel pair element ("channel_pair_element") typically comprises a plurality of frequency-domain channel streams. Also, the channel pair element may comprise time warp information, like, for example, a time warp activation flag ("tw_MDCT"), which may be transmitted in a configuration data stream element or in the "USAC_raw_data_block", and which determines whether time warp information is included in the channel pair element. For example, if the "tw_MDCT" flag indicates that the time warp is active, the channel pair element may comprise a flag ("common_tw"), which indicates whether there is a common time warp for the audio channels of the channel pair element. If said flag ("common_tw") indicates that there is a common time warp for multiple of the audio channels, then a common time warp information ("tw_data") is included in the channel pair element, for example, separate from the frequency-domain channel streams.

Taking reference now to FIG. 17*d*, the frequency-domain channel stream is described. As can be seen from FIG. 17*d*, the frequency-domain channel stream, for example, comprises a global gain information. Also, the frequency-domain channel stream comprises time warp data, if the time warping is active (flag "tw_MDCT" is active) and if there is no common time warp information for multiple audio signal channels (flag "common_tw" is inactive).

Further, a frequency-domain channel stream also comprises scale factor data ("scale_factor_data") and encoded spectral data (for example, arithmetically encoded spectral data "ac_spectral_data").

Taking reference now to FIG. 17*e*, the syntax of the time warp data is briefly discussed. The time warp data may, for example, optionally comprise a flag (e.g., "tw_data_present" or "active_pitch_data") indicating whether time warp data is present. If the time warp data is present (i.e., the time warp contour is not flat), the time warp data may comprise the sequence of a plurality of encoded time warp ratio values (e.g., "tw_ratio[i]" or "pitch Idx[i]"), which may, for example, be encoded according to a sampling-rate dependent codebook table, as is described above.

Thus, the time warp data may comprise a flag indicating that there is no time warp data available, which may be set by an audio signal encoder, if the time warp contour is constant (time warp ratios are approximately equal to 1.000). In contrast, if the time warp contour is varying, ratios between subsequent time warp contour nodes may be encoded using the codebook indices, making up the "tw_ratio" information.

FIG. 17*f* shows a graphical representation of the syntax of the arithmetically coded spectral data "ac_spectral_data( )". The arithmetically coded spectral data are encoded in dependence on the status of an independency flag (here: "indepFlag"), which indicates, if active, that the arithmetically coded data are independent from arithmetically encoded data of a previous frame. If the independency flag "indepFlag" is active, an arithmetic reset flag "arith_reset_flag" is set to be active. Otherwise, the value of the arithmetic reset flag is determined by a bit in the arithmetically coded spectral data.

Moreover, the arithmetically coded spectral data block "ac_spectral_data( )" comprises one or more units of arithmetically coded data, wherein the number of units of arithmetically coded data "arith_data( )" is dependent on a number of blocks (or windows) in the current frame. In a long block mode, there is only one window per audio frame. However, in a short block mode, there may be, for example, eight windows per audio frame. Each unit of arithmetically coded spectral data "arith_data" comprises a set of spectral coefficients, which may serve as the input for a frequency-domain-to-time-domain transform, which may be performed, for example, by the inverse transform 240*c*.

The number of spectral coefficients per unit of arithmetically encoded data "arith_data" may, for example, be independent of the sampling frequency, but may be dependent on the block length mode (short block mode "EIGHT_SHORT_SEQUENCE" or long block mode "ONLY_LONG_SEQUENCE").

9. Conclusions

To summarize the above, an improvement for the time-warped-modified-discrete-cosine-transform (TW-MDCT) has been described. The invention described above is in the context of a time-warped MDCT transform coder and creates methods for an improved performance of a warped MDCT transform coder. For details regarding the time-warped modified-discrete-cosine-transform, the reader's attention is drawn to references [1] and [2].

One implementation of such a time-warped-MDCT-transform coder is realized in the ongoing MPEG USAC audio coding standardization work (see, for example, reference [3]). Details of the used time-warped MDCT implementation can be found in reference [4].

Moreover, it should be noted that the audio signal encoder and the audio signal decoder described herein comprise the features which are described in international patent applications WO/2010/003583, WO/2010/003618, WO/1010/003581 and WO/2010/003582. The teachings of said four international patent applications are explicitly incorporated herein. The features and characteristics disclosed in said four international patent applications can be incorporated into the embodiments according to the present invention.

10. Implementation Alternative

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

References

[1] Bernd Edler et. al., "Time Warped MDCT", U.S. 61/042,314, Provisional application for patent,

[2] L. Villemoesg, "Time Warped Transform Coding of Audio Signals", PCT/EP2006/010246, International patent application, November 2005.

[3] "WD6 of USAC", ISO/IEC JTC1/SC29/WG11 N11213, 2010

[4] Bernd Edler et. al., "A Time-Warped MDCT Approach to Speech Transform Coding", 126th AES Convention, Munich, May 2009, preprint 7710

[5] Nikolaus Meine, "Vektorquantisierung and kontextabhangige arithmetische Codierung für MPEG-4 AAC", VDI, Hannover, 2007

The invention claimed is:

1. An audio signal decoder configured to provide a decoded audio signal representation on the basis of an encoded audio signal representation comprising a sampling frequency information, an encoded time warp information and an encoded spectrum representation, the audio signal decoder comprising:

a time warp calculator configured to map the encoded time warp information onto a decoded time warp information, wherein the time warp calculator is configured to adapt a mapping rule for mapping codewords of the encoded time warp information onto decoded time warp values describing the decoded time warp information in dependence on the sampling frequency information; and a warp decoder configured to provide the decoded audio signal representation on the basis of the encoded spectrum representation and in dependence on the decoded time warp information;

wherein the audio signal decoder is implemented using a hardware apparatus, or using a computer, or using a combination of a hardware apparatus and a computer.

2. The audio signal decoder according to claim 1, wherein the codewords of the encoded time warp information describe a temporal evolution of a time warp contour, and wherein the time warp calculator is configured to evaluate a predetermined number of codewords of the encoded time warp information for an audio frame of an encoded audio signal represented by the encoded audio signal representation, wherein the predetermined number of codewords is independent from a sampling frequency of the encoded audio signal.

3. The audio signal decoder according to claim 1, wherein the time warp calculator is configured to adapt the mapping rule such that a range of decoded time warp values onto which codewords of a given set of codewords of the encoded time warp information are mapped, is larger for a first sampling frequency than for a second sampling frequency provided the first sampling frequency is smaller than the second sampling frequency.

4. The audio signal decoder according to claim 3, wherein the decoded time warp values are time warp contour values representing values of a time warp contour or time warp contour variation values representing an absolute or relative change of values of a time warp contour.

5. The audio signal decoder according to claim 1, wherein the time warp calculator is configured to adapt the mapping rule such that a maximum change of pitch over a given number of samples of an encoded audio signal represented by the encoded audio signal representation, which is representable by a given set of codewords of the encoded time warp information is larger for a first sampling frequency than for a second sampling frequency, provided the first sampling frequency is smaller than the second sampling frequency.

6. The audio signal decoder according to claim 1, wherein the time warp calculator is configured to adapt the mapping rule such that a maximum change of pitch over a given time period, which is representable by a given set of codewords of the encoded time warp information at a first sampling frequency, differs from a maximum change of pitch over the given time period, which is representable by the given set of codewords of the encoded time warp information at a second sampling frequency, by no more than 10% for a first sampling frequency and a second sampling frequency differing by at least 30%.

7. The audio signal decoder according to claim 1, wherein the time warp calculator is configured to use different mapping tables for mapping codewords of the encoded time warp information onto decoded time warp values in dependence on the sampling frequency information.

8. The audio signal decoder according to claim 1, wherein the time warp calculator is configured to adapt reference mapping values, which describe decoded time warp values associated with different codewords of the encoded time warp information for a reference sampling frequency, to an actual sampling frequency different from the reference sampling frequency, to acquire adapted mapping values.

9. The audio signal decoder according to claim 8, wherein the time warp calculator is configured to scale a portion of the reference mapping values, which describes a time warp, in dependence on a ratio between the actual sampling frequency and the reference sampling frequency.

10. The audio signal decoder according to claim 1, wherein the decoded time warp values describe a variation of a time warp contour over a predetermined number of samples of the encoded audio signal represented by the encoded audio signal representation, and wherein the audio signal decoder comprises a sampling position calculator, wherein the sampling position calculator is configured to combine a plurality of decoded time warp values, which represent a variation of the time warp contour, to derive a warp contour node value, such that a deviation of the derived warp contour node values from a reference warp node value is larger than a deviation representable by a single one of the decoded time warp values.

11. The audio signal decoder according to claim 1, wherein the decoded time warp values describe a relative change of a time warp contour over a predetermined number of samples of the encoded audio signal represented by the encoded audio signal representation, and wherein the audio signal decoder comprises a sampling position calculator, wherein the sampling position calculator is configured to derive a time warp contour information from the decoded time warp values.

12. The audio signal decoder according to claim 1, wherein the audio signal decoder comprises a sampling position calculator, wherein the sampling position calculator is configured to compute supporting points of a time warp contour on the basis of the decoded time warp values, and wherein the sampling position calculator is configured to interpolate between the supporting points, to acquire the time warp contour, and wherein a number of decoded time warp values per audio frame is independent of the sampling frequency.

13. An audio signal encoder for providing an encoded representation of an audio signal, the audio signal encoder comprising:

a time warp contour encoder configured to map time warp values describing a time warp contour onto an encoded time warp information, wherein the time warp contour encoder is configured to adapt a mapping rule for mapping the time warp values describing the time warp contour onto codewords of the encoded time warp information in dependence on a sampling frequency of the audio signal; and a time warping signal encoder configured to acquire an encoded representation of a spectrum of the audio signal, taking into account a time warp described by the time warp contour information, wherein the encoded representation of the audio signal comprises the codeword of the encoded time warp information, the encoded representation of the spectrum and a sampling frequency information describing the sampling frequency; and wherein the audio signal decoder is implemented using a hardware apparatus, or using a computer, or using a combination of a hardware apparatus and a computer.

14. A method for providing a decoded audio signal representation on the basis of an encoded audio signal representation comprising a sampling frequency information, an encoded time warp information and an encoded spectrum representation, the method comprising:

mapping the encoded time warp information onto a decoded time warp information, wherein a mapping rule for mapping codewords of the encoded time warp information onto decoded time warp values describing the decoded time warp information is adapted in dependence on the sampling frequency information; and providing the decoded audio signal representation on the basis of the encoded spectrum representation and in dependence on the decoded time warp information;

wherein the method is performed using a hardware apparatus, or using a computer, or using a combination of a hardware apparatus and a computer.

15. A method for providing an encoded representation of an audio signal, the method comprising:

mapping time warp values describing a time warp contour onto an encoded time warp information, wherein a mapping rule for mapping the time warp values describing the time warp contour onto codewords of the encoded time warp information is adapted in dependence on a sampling frequency of the audio signal;

acquiring an encoded representation of a spectrum of the audio signal, taking into account a time warp described by the time warp contour information;

wherein the encoded representation of the audio signal comprises the codewords of the encoded time warp information, the encoded representation of the spectrum and a sampling frequency information describing the sampling frequency; and wherein the method is performed using a hardware apparatus, or using a computer, or using a combination of a hardware apparatus and a computer.

16. A non-transitory digital storage medium comprising a computer program for performing the method according to claim 14 when the computer program runs on the hardware apparatus, or the computer, or the combination of the hardware apparatus and the computer.

17. A non-transitory digital storage medium comprising a computer program for performing the method according to claim 15 when the hardware apparatus, or the computer, or the combination of the hardware apparatus and the computer.

* * * * *